US005478719A

United States Patent [19]

Hioki et al.

[11] Patent Number: 5,478,719

[45] Date of Patent: Dec. 26, 1995

[54] SILVER HALIDE PHOTOGRAPHIC MATERIAL

[75] Inventors: Takanori Hioki; Hiroshi Kawakami, both of Kanagawa, Japan

[73] Assignee: Fuji Photo Film Co., Ltd., Kanagawa, Japan

[21] Appl. No.: 306,588

[22] Filed: Sep. 15, 1994

[30] Foreign Application Priority Data

Sep. 16, 1993 [JP] Japan ..... 5-252176

[51] Int. Cl.[6] ..... G03C 1/12; G03C 1/24; G03C 1/29

[52] U.S. Cl. ..... 430/572; 430/573; 430/576; 430/577; 430/578; 430/579; 430/580; 430/581

[58] Field of Search ..... 430/580, 572, 430/576, 577, 578, 579, 573, 581

[56] References Cited

U.S. PATENT DOCUMENTS

| | | | |
|---|---|---|---|
| 2,393,351 | 1/1946 | Wilson | 430/579 |
| 2,425,772 | 8/1947 | Wilson | 430/579 |
| 2,425,773 | 8/1947 | Wilson | 430/579 |
| 2,425,774 | 8/1947 | Wilson | 548/176 |
| 3,622,317 | 11/1971 | Bird et al. | 430/581 |
| 3,976,493 | 8/1976 | Borror et al. | 430/578 |
| 5,285,738 | 2/1994 | Vishwakarma et al. | 430/579 |

*Primary Examiner*—Lee C. Wright

*Attorney, Agent, or Firm*—Sughrue, Mion, Zinn, Macpeak & Seas

[57] ABSTRACT

The present invention provides a high sensitivity silver halide photographic material which minimizes the formation of fog and exhibits a small sensitivity drop during storage. A silver halide photographic material is provided comprising a compound having a methine dye and a styryl base covalently connected to each other.

12 Claims, No Drawings

SILVER HALIDE PHOTOGRAPHIC MATERIAL

FIELD OF THE INVENTION

The present invention relates to a silver halide photographic material having a high sensitivity and an excellent storage stability. More particularly, the present invention relates to a novel compound.

BACKGROUND OF THE INVENTION

Heretofore, it has been desired to provide silver halide photographic materials with a higher sensitivity. In particular, it has been keenly desired to provide spectrally sensitized silver halide photographic materials with a higher sensitivity.

A spectral sensitizing technique is an extremely important and indispensable technique in the preparation of a high sensitivity light-sensitive material which exhibits an excellent color reproducibility. A spectral sensitizer has an inherent effect of absorbing light in the long wavelength range that is not substantially absorbed by a silver halide photographic emulsion and transferring its light energy to the silver halide. Thus, the rise in the amount of light captured by the spectral sensitizer is favorable for enhancing photographic sensitivity. Accordingly, attempts to enhance the captured amount of light have been made by increasing the amount of a spectral sensitizer to be added to the silver halide emulsion. However, if the amount of the spectral sensitizer to be added to the silver halide emulsion exceeds its optimum value, it causes a great desensitization. This is a phenomenon normally called dye desensitization which occurs in the inherent sensitive wavelength range of silver halides where there is no light absorption by sensitizing dyes. When a great desensitization occurs, it gives a reduced overall sensitivity, despite the spectral sensitizing effect. In other words, the less dye desensitization is, the more is the sensitivity in the wavelength range of light absorption by the sensitizing dye (i.e., spectral sensitization). Accordingly, the reduction of dye desensitization is an important assignment in the spectral sensitizing technique. The longer the sensitive wavelength range of sensitizing dye is, the more is dye desensitization. This phenomenon is further described in T. H. James, *"The Theory of the Photographic Process"*, pp. 265–268, Macmillan, 1966.

As described in Tadaaki Tani, *"Journal of the Physical Chemistry"*, vol. 94, page 1298, 1990, it has been known that sensitizing dyes having a reduction potential of higher than −1.25 V show a low relative quantum yield of spectral sensitization. In order to enhance the relative quantum yield of spectral sensitization of such dyes, it has been proposed to effect supersensitization by capturing positive holes as described in the above cited *"The Theory of the Photographic Process"*, pp. 259–265, 1966.

As the foregoing supersensitizer for eliminating desensitization there may be used a compound having a lower oxidation potential than sensitizing dyes. For example, U.S. Pat. Nos. 2,313,922, 2,075,046, 2,448,858, and 2,680,686, British Patent 1,230,449, and Belgian Patent 771,168 disclose styryl bases.

However, these styryl bases have an insufficient effect of providing a higher sensitivity. Further, these styryl bases are disadvantageous in that they are poor in storage stability.

SUMMARY OF THE INVENTION

It is an object of the present invention to provide a silver halide photographic material having a high sensitivity.

It is another object of the present invention to provide a silver halide photographic material having a high storage stability.

It is a further object of the present invention to provide a novel compound.

These and other objects of the present invention will become more apparent from the following detailed description and examples.

The foregoing objects of the present invention are accomplished with a silver halide photographic material, comprising at least one compound having a methine dye and a styryl base covalently bonded to each other.

The foregoing compound is preferably one represented by formula (I):

$$(MET)_{k1}-(Q)_{k2}-(ST)]_{k3}$$

wherein MET represents an atomic group having a methine dye structure; Q represents a divalent linkage group comprising an atom or atomic group containing at least one of carbon atom, nitrogen atom, sulfur atom and oxygen atom; ST represents an atomic group having a styryl base structure; $k_1$ and $k_3$ each represents an integer 0 to 4; and $k_2$ represents an integer 0 or 1.

DETAILED DESCRIPTION OF THE INVENTION

The present invention will be further described hereinafter.

In formula (I), the group represented by MET normally represents a cyanine structure having a nitrogen-containing heterocyclic group called a basic nucleus and another such nitrogen-containing heterocyclic group connected to each other by a conjugated double bond such that they are conjugated to each other, a melocyanine structure having a heterocyclic group called an acidic nucleus and a basic nucleus connected to each other a conjugated double bond such that a carbonyl group in the acidic nucleus and a nitrogen atom in the basic nucleus are conjugated to each other, or a rhodacyanine structure having the above structures, oxonol structure, hemicyanine structure, styryl structure or benzylidene structure having these structures in combination.

The group ST represents a styryl base structure.

Examples of such a polymethine dye are described in T. H. James, *"The Theory of the Photographic Process"*, 1977, Macmillan, Chapter 8, F. M. Hamer, *"Heterocyclic Compounds- Cyanine Dyes and Related Compounds"*, John Wiley & Sons, New York, London, 1964, D. M. Sturmer, *"Heterocyclic Compounds- Special topics in heterocyclic chemistry"*, chapter 18, Section 14, pp. 482–515, John Wiley & Sons, New York, London, 1977, *"Rodd's Chemistry of Carbon Compounds"*, 2nd. Ed., vol. IV, part B, 1977, chapter 15, pp. 369–422, 2nd. Ed., vol. IV, part B, 1985, chapter 15, pp. 267–296, Elsvier Science Publishing Company Inc., New York, etc.

The styryl base structure which may be preferably used as ST in the present invention is a compound represented by formula (A)

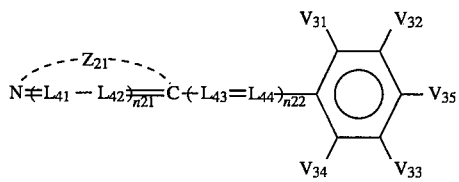

(A)

wherein $Z_{21}$ represents an atomic group necessary for the formation of a 5- or 6-membered nitrogen-containing heterocyclic group; $V_{31}$, $V_{32}$, $V_{33}$, $V_{34}$ and $V_{35}$ each represents a hydrogen atom or a monovalent group; $L_{41}$, $L_{42}$, $L_{43}$ and $L_{44}$ each represents a methine group; $n_{21}$ represents 0 or 1; and $n_{22}$ represents 1, 2 or 3, provided that the styryl base structure is substituted by at least one —$(Q)_{k2}$—$(MET)_{k1}$.

The suffix $k_1$ is preferably 1 or 2. The suffix $k_3$ is preferably 1, 2, 3 or 4. More preferably, $k_1$, $k_2$ or $K_3$ is 1.

In the present invention, the cyanine structure which can be preferably used as MET is represented by formula (II). The melocyanine structure which can be preferably used as MET is represented by formula (III) . The rhodacyanine structure which can be preferably used as MET is represented by formula (IV).

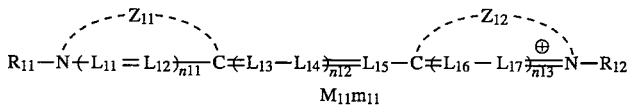

(II)

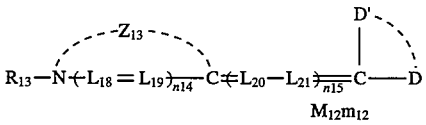

(III)

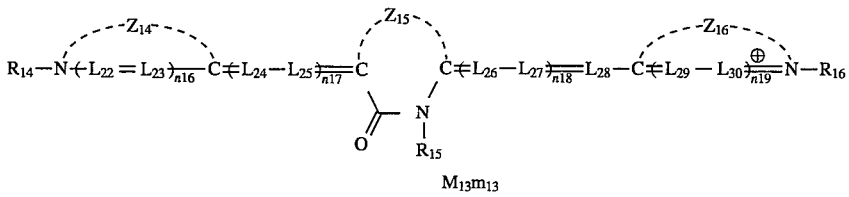

(IV)

For details of the styryl base represented by ST, reference can be made to the above cited *"The Chemistry of Heterocyclic Compounds"*, chapter 13, pp. 433–436, U.S. Pat. Nos. 2,313,922, 2,075,046, 2,448,858, and 2,680,686, British Patent 1,230,449, and Belgian Patent 771,168.

Q represents a divalent linkage group having a covalent bond and a divalent linkage group comprising an atom or atomic group containing at least one of carbon atom, nitrogen atom, sulfur atom and oxygen atom.

Preferably, Q represents a divalent linkage group having 20 or less carbon atoms (more preferably 1 to 12 carbon atoms), comprising one or more groups selected from an alkylene group (e.g., methylene, ethylene, propylene, butylene, pentylene), arylene group (e.g., phenylene, naphthylene), alkenylene group (e.g., ethenylene, propenylene), carbonamide group, ester group, sulfonamide group, sulfonic ester group, ureide group, sulfonyl group, sulfinyl group, thioether group, ether group, carbonyl group, —$N(R^1)$— (in which $R^1$ represents a hydrogen atom or a substituted or unsubstituted alkyl or aryl group) and a divalent heterocyclic group (e.g., 6-chloro-1,3,5 -triazine-2,4-diil, pyrimidine-2,4-diil, quinoxaline-2,3-diil). Further preferred among these groups are ester group (—COO—) and carbonamide group (—NHCO—).

In these formulae, $Z_{11}$, $Z_{12}$, $Z_{13}$, $Z_{14}$, $Z_{15}$ and $Z_{16}$ each represents an atomic group necessary for the formation of a 5- or 6-membered nitrogen-containing heterocyclic group.

D and D' each represents an atomic group necessary for the formation of a noncyclic or cyclic acidic nucleus.

$R_{11}$, $R_{12}$, $R_{13}$, $R_{14}$ and $R_{16}$ each represents a substituted or unsubstituted alkyl group.

$R_{15}$ represents a substituted or unsubstituted alkyl group, aryl group or heterocyclic group.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{29}$ and $L_{30}$ each represents a substituted or unsubstituted methine group.

$M_{11}$, $M_{12}$ and $M_{13}$ each represents a charge neutralizing paired ion, $m_{11}$, $m_{12}$ and $m_{13}$ each represents a number of 0 or more necessary for the neutralization of electric charge in the molecule.

The suffixes $n_{11}$, $n_{13}$, $n_{14}$, $n_{16}$ and $n_{19}$ each represent an integer 0 or 1.

The suffixes $n_{12}$, $n_{15}$, $n_{17}$ and $n_{18}$ each represent an integer 0 or more.

Further preferably, MET is a sensitizing dye structure called cyanine represented by formula (II), provided that the dye structures represented by formulae (II), (III), and (IV) each is substituted by at least one —$(Q)_{k2}$—(ST).

Formulae (II), (III), and (VI) will be further described hereinafter.

Preferably, $R_{11}$, $R_{12}$, $R_{13}$, $R_{14}$ and $R_{16}$ are each an unsubstituted alkyl group having 18 or less carbon atoms (e.g., methyl, ethyl, propyl, butyl, pentyl, octyl, decyl, dodecyl, octadecyl) or substituted alkyl group having 18 or less carbon atoms. Examples of substituents on such a substituted alkyl group include carboxyl group, sulfo group, cyano group, halogen atom (e.g., fluorine, chlorine, bromine), hydroxyl group, alkoxycarbonyl group (e.g., methoxycarbonyl, ethoxycarbonyl, phenoxycarbonyl, benzyloxycarbonyl), alkoxy group having 8 or less carbon atoms (e.g., methoxy, ethoxy, benzyloxy, phenethyloxy), monocyclic aryloxy group having 10 or less carbon atoms (e.g., phenoxy, p-tollyloxy), acyloxy group having 3 or less carbon atoms (e.g., acetyloxy, propionyloxy), acyl group having 8 or less carbon atoms (e.g., acetyl, propionyl, benzoyl, mesyl), carbamoyl group (e.g., carbamoyl, N,N-dimethylcarbamoyl, morpholinocarbonyl, piperidinocarbonyl), sulfamoyl group (e.g., sulfamoyl, N,N-dimethylsulfamoyl, morpholinosulfonyl, piperidinosulfonyl), and aryl group having 10 or less carbon atoms (e.g., phenyl, 4-chlorophenyl, 4 -methylphenyl, α-naphthyl). More preferably, $R_{11}$, $R_{12}$, $R_{13}$, $R_{14}$ and $R_{16}$ are each an unsubstituted alkyl group (e.g., methyl, ethyl, n-propyl, n-butyl, n-pentyl, n-hexyl), carboxyalkyl group (e.g., 2-carboxyethyl, carboxymethyl), sulfoalkyl group (e.g., 2-sulfoethyl, 3-sulfopropyl, 4-sulfobutyl, 3-sulfobutyl) or methanesulfonylcarbamoylmethyl group.

$M_{11}m_{11}$, $M_{12}m_{12}$ and $M_{13}m_{13}$ are contained in the above formulae to indicate the presence or absence of cation or anion when required to neutralize ionic charge of dye. Whether a dye is a cation or anion or not or has a net ionic charge or not depends on its auxochromes and substituents. Typical examples of cation include inorganic or organic ammonium ions (e.g., ammonium ion, tetraalkylammonium ion, pyridinium ion), alkaline metal ions (e.g., sodium ion, potassium ion), and alkaline earth metal ions (e.g., calcium ion). On the other hand, the anion may be either inorganic anion or organic anion. Specific examples of such an anion include halogen anion (e.g., fluorine ion, chlorine ion, bromine ion, iodine ion), substituted arylsulfonate ion (e.g., p-toluenesulfonate ion, p-chlorobenzenesulfonate ion), aryldisulfonate ion (e.g., 1,3 -benzenedisulfonate ion, 1,5-naphthalenedisulfonate ion, 2,6 -naphthalenedisulfonate ion), alkylsulfate ion (e.g., methylsulfate ion, ethylsulfate ion), sulfate ion, thiocyanate ion, perchlorate ion, tetrafluoroborate ion, picrate ion, acetate ion, and trifluoromethanesulfonate ion.

As the charge neutralizing paired ion there may be used an ionic polymer or other dye having opposite electric charge to the dye. Further, a metal complex ion (e.g., bisbenzene-1,2-dithiorate nickel (III)) can be used.

Preferred among the foregoing ions are ammonium ion, iodine ion, and p-toluenesulfonate ion.

The suffixes $m_{11}$, $m_{12}$ and $m_{13}$ are each preferably 0, 1 or 2.

Examples of the nucleus formed by $Z_{11}$, $Z_{12}$, $Z_{13}$, $Z_{14}$ and $Z_{16}$ include thiazole nucleus such as thiazole nucleus (e.g., thiazole, 4-methylthiazole, 4-phenylthiazole, 4,5-dimethylthiazole, 4,5-diphenylthiazole), benzothiazole nucleus (e.g., benzothiazole, 4-chlorobenzothiazole, 5-chlorobenzothiazole, 6 -chlorobenzothiazole, 5-nitrobenzothiazole, 4-methylbenzothiazole, 5-methylthiobenzothiazole, 5-methylbenzothiazole, 6 -methylbenzothiazole, 5-bromobenzothiazole, 6-bromobenzothiazole, 5-iodobenzothiazole, 5-phenylbenzothiazole, 5 -methoxybenzothiazole, 6-methoxybenzothiazole, 6-methylbenzothiazole, 5-ethoxybenzothiazole, 5-ethoxycarbonylbenzothiazole, 5-carboxybenzothiazole, 5-phenethylbenzothiazole, 5 -fluorobenzothiazole, 5-chloro-6-methylbenzothiazole, 5,6 -dimethylbenzothiazole, 5,6-dimethylthiobenzothiazole, 5,6 -dimethoxybenzothiazole, 5-hydroxy-6-methylbenzothiazole, tetrahydrobenzothiazole, 4-phenylbenzothiazole), and naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8 -methoxynaphtho[2,1-d]thiazole, 5-methoxynaphtho[2,3 -d]thiazole), thiazoline nucleus (e.g. , thiazoline, 4-methylthiazoline, 4-nitrothiazoline ) , oxazole nucleus such as oxazole nucleus (e.g., oxazole, 4 -methyloxazole, 4-nitrooxazole, 5 -methyloxazole, 4-phenyloxazole, 4,5-diphenyloxazole, 4-ethyloxazole), benzooxazole nucleus (e.g., benzooxazole, 5 -chlorobenzooxazole, 5-methylbenzooxazole, 5-bromobenzooxazole, 5-fluorobenzooxazole, 5-phenylbenzooxazole, 5-methoxybenzooxazole, 5-nitrobenzooxazole, 5-trifluoromethylbenzooxazole, 5 -hydroxybenzooxazole, 5-carboxybenzooxazole, 6-methylbenzooxazole, 6-chlorobenzooxazole, 6-nitrobenzooxazole, 6-methoxybenzooxazole, 6-hydroxybenzooxazole, 5,6-dimethylbenzooxazole, 4,6-dimethylbenzooxazole, 5-ethoxybenzooxazole), naphthooxazole nucleus (e.g., naphtho[2,1-d]oxazole, naphtho [1,2 -d]oxazole, naphtho[2,3-d]oxazole, 5-nitronaphtho[2,1 -d]oxazole), oxazoline nucleus (e.g., 4,4-dimethyloxazoline), selenazole nucleus such as selenazole nucleus (e.g., 4 -methylselenazole, 4-nitroselenazole, 4-phenylselenazole), benzoselenazole nucleus (e.g., benzoselanzole, 5-chlorobenzoselenazole, 5-nitrobenzoselenazole, 5-methoxybenzoselenazole, 5-hydroxybenzoselenazole, 6-nitrobenzoselenazole, 5-chloro-6 -nitrobenzoselenazole, 5,6-dimethylbenzoselenazole), and naphthoselenazole nucleus (e.g., naphtho[2,1-d]selenazole, naphtho[1,2-d]selenazole), selenazoline nucleus (e.g., selenazoline, 4-methylselenazoline), tellurazole nucleus such as tellurazole nucleus (e.g., tellurazole, 4-methyltellurazole, 4-phenyltellurazole), benzotellurazole nucleus (e.g., benzotellurazole, 5-chlorobenzotellurazole, 5 -methylbenzotellurazole, 5,6-dimethylbenzotellurazole, 6 -methoxybenzotellurazole), and naphthotellurazole nucleus (e.g., naphtho[2,1-d]tellurazole, naphtho[1,2-d]tellurazole), tellurazoline nucleus (e.g., tellurazoline, 4-methyltellurazoline), 3,3-dialkylindolenine nucleus (e.g., 3,3 -dimethylindolenine, 3,3-diethylindolenine, 3,3-dimethyl-5 -cyanoindolenine, 3,3-dimethyl-6-nitroindolenine, 3,3-dimethyl-5-nitroindolenine, 3,3-dimethyl-5-methoxyindolenine, 3,3,5 -trimethylindolenine, 3,3-dimethyl-5-chloroindolenine), imidazole nucleus such as imidazole nucleus (e.g., 1 -alkylimidazole, 1-alkyl-4-phenylimidazole, 1-arylimidazole), benzoimidazole nucleus (e.g., 1-alkylbenzoimidazole, 1-alkyl-5 -chlorobenzoimidazole, 1-alkyl-5,6-dichlorobenzoimidazole, 1 -alkyl-5-methoxybenzoimidazole, 1-alkyl-5-cyanobenzoimidazole, 1-alkyl-5-fluorobenzoimidazole, 1-alkyl-5-trifluoromethylbenzoimidazole, 1-alkyl-6-chloro-5-cyanobenzoimidazole, 1-alkyl-6 -chloro-5-trifluoromethylbenzoimidazole, 1-allyl-5,6 -dichchlorobenzoimidazole, 1-allyl-5-chlorobenzoimidazole, 1-arylbenzoimidazole, 1-aryl-5-chlorobenzoimidazole, 1-aryl-5,6 -dichlorobenzoimidazole, 1-aryl-5-methoxybenzoimidazole, 1-aryl-5-cyanobenzoimidazole), and naphthoimidazole nucleus (e.g., alkylnaphtho[1,2-d] imidazole, 1-arylnaphtho[1,2-d]imidazole) (The foregoing alkyl group in imidazole nucleus is preferably a $C_{1-8}$ alkyl group. Preferred examples of such an alkyl group include unsubstituted alkyl group such as methyl, ethyl, propyl, isopropyl and butyl, and hydroxyalkyl group such as 2

-hydroxyethyl and 3-hydroxypropyl. Particularly preferred among these alkyl groups are methyl group and ethyl group. The foregoing aryl group in imidazole nucleus is phenyl, halogen(e.g., chloro)-substituted phenyl, alkyl(e.g., methyl)-substituted phenyl or alkoxy(e.g., methoxy)-substituted phenyl.), pyridine nucleus (e.g., 2-pyridine, 4-pyridine, 5 -methyl-2-pyridine, 3-methyl-4-pyridine), quinoline nucleus such as quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2 -quinoline, 8-chloro-2-quinoline, 4-quinoline, 6-ethoxy-4 -quinoline, 6-nitro-4-quinoline, 8-chloro-4-quinoline, 8-fluoro-4-quinoline, 8-methyl-4-quinoline, 8-methoxy-4-quinoline, 6 -methyl-4-quinoline, 6-methoxy-4-quinoline, 6-chloro-4-quinoline), and isoquinoline nucleus (e.g., 6-nitro-1 -isoquinoline, 3,4-dihydro-1-isoquinoline, 6-nitro-3 -isoquinoline), imidazo[4,5-b]quinoxaline nucleus (e.g., 1,3 -diethylimidazo[4,5-b]quinoxaline, 6-chloro-l,3-diallylimidazo-[4,5-b]quinoxaline), oxadiazole nucleus, thiadiazole nucleus, tetrazole nucleus, and pyrimidine nucleus.

Preferred examples of the nucleus formed by $Z_{11}$, $Z_{12}$, $Z_{13}$, $Z_{14}$ and $Z_{16}$ include benzothiazole nucleus, naphthothiazole nucleus, benzooxazole nucleus, naphthooxazole nucleus, benzoimidazole nucleus, 2-quinoline nucleus, and 4-quinoline nucleus.

D and D' each represents an atomic group necessary for the formation of an acidic nucleus. These atomic groups may be in the form of acidic nucleus of any ordinary melocyanine dye. The term "acidic nucleus" as used herein is as defined in James, "*The Theory of the Photographic Process*", 4th ed., Macmillan, 1977, page 198. In a preferred form, the substituent that takes part in the resonance of D may be a carbonyl group, cyano group, sulfonyl group or sulfenyl group. D' represents the rest of atomic group necessary for the formation of acidic nucleus.

Specific examples of such an atomic group include those described in U.S. Pat. Nos. 3,567,719, 3,575,869, 3,804,634, 3,837,862, 4,002,480, and 4,925,777, and JP-A-3-167546 (The term "JP-A" as used herein means an "unexamined published Japanese patent application").

When the acidic nucleus is noncyclic, the methine bond is terminated by a group such as malononitrile, alkanesulfonylacetonitrile, cyanomethylbenzofuranylketone and cyanomethylphenylketone.

When D and D' are cyclic, they form a 5- or 6-membered heterocyclic group comprising carbon, nitrogen and chalcogen (typically oxygen, sulfur, selenium, tellurium) atoms.

Preferred examples of such an acidic nucleus include 2 -pyrazoline-5-one, pyrazolidine-3,5-dione, imidazoline-5-one, hydantoin, 2- or 4-thiohydantoin, 2-iminooxazolidine-4-one, 2 -oxazoline-5-one, 2-thiooxazolidine-2,4-dione, isooxazoline-5 -one, 2-thiazoline-4-one, thiazolidine-4-one, thiazolidine-2,4 -dione, rhodanine, thiazolidine-2,4-dithione, isorhodanine, indane-1,3-dione, thiophene-3-one-1,1-dioxide, indoline-2-one, indoline-3-one, indazoline-3-one, 2-oxoindazolinium, 3-oxoindazolinium, 5,7-dioxo-6,7-dihydrothiazolo[3,2 -a]pyrimidine, cyclohexane-1,3-dione, 3,4-dihydroisoquinoline-4 -one, 1,3-dioxane-4,4 -dione, barbituric acid, 2-thiobarbituric acid, chroman-2,4-dione, indazoline-2-one, pyrido[1,2 -a]pyrimidine-1,3-dione, pyrazolo[1,5-b]quinazolone, pyrazolo[1,5-a]benzoimidazole, pyrazolopyridone, 1,2,3,4-tetrahydroquinoline- 2,4-dione, 3-oxo-2,3-dihydrobenzo[d]thiophene-1,1 -dioxide, and 3-dicyanomethine-2,3-dihydrobenzo[d]thiophene-1,1 -dioxide.

Even more preferred among these acidic nuclei are 3 -alkylrhodanine, 3-alkyl-2-thiooxazolidine-2,4-dione, and 3 -alkyl-2-thiohydantoin.

Examples of substituents connected to nitrogen atom contained in these acidic nuclei and $R_{15}$ include alkyl group having 18 or less carbon atoms (e.g., methyl, ethyl, propyl, isopropyl, butyl, isobutyl, hexyl, octyl, dodecyl, octadecyl), aryl group having 18 or less carbon atoms (e.g., phenyl, 2 -naphthyl, 1-naphthyl), and heterocyclic group having 18 or less carbon atoms (e.g., 2-pyridyl, 2-thiazolyl, 2-furyl). These substituents may be further substituted by other substituents. Examples of such substituents include carboxyl group, sulfo group, cyano group, nitro group, halogen atom (e.g., fluorine, chlorine, iodine, bromine), hydroxyl group, alkoxy group having 8 or less carbon atoms (e.g., methoxy, ethoxy, benzyloxy, phenethyloxy), aryloxy group having 15 or less carbon atoms (e.g., phenoxy), acyloxy group having 8 or less carbon atoms (e.g., acetyloxy), alkoxycarbonyl group having 8 or less carbon atoms, acyl group having 8 or less carbon atoms, sulfamoyl group, carbamoyl group, alkanesulfonylaminocarbonyl group having 8 or less carbon atoms (e.g., methanesulfonylaminocarbonyl), acylaminosulfonyl group having 8 or less carbon atoms (e.g., acetylaminosulfonyl), aryl group having 15 or less carbon atoms (e.g., phenyl, 4-methylphenyl, 4-chlorophenyl, naphthyl), and heterocyclic group having 15 or less carbon atoms (e.g., pyrrolidine-2-one-1-il, tetrahydrofurfuryl, 2 -morphonino). These substituents may be further substituted by these substituents.

Even more preferred among these substituents are unsubstituted alkyl group (e.g., methyl, ethyl, n-propyl, n-butyl, n-pentyl, n-hexyl), carboxyalkyl group (e.g., carboxymethyl, 2-carboxyethyl), and sulfoalkyl group (e.g., 2 -sulfoethyl).

The 5- or 6-membered nitrogen-containing heterocyclic group formed by $Z_{15}$ is obtained by elimination of oxo group or thioxo group in a proper position from a cyclic heterocyclic group represented by D and D', preferably by elimination of thioxo group from a rhodanine nucleus.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$ and $L_{30}$ each represents a substituted or unsubstituted methine group. Examples of substituents on such a substituted methine group include substituted or unsubstituted alkyl group (e.g., methyl, ethyl, 2-carboxyethyl), substituted or unsubstituted aryl group (e.g., phenyl, o-carboxyphenyl), heterocyclic group (e.g., barbituric acid), halogen atom (e.g., chlorine, bromine), alkoxy group (e.g., methoxy, ethoxy), amino group (e.g., N,N-diphenylamino, N-methyl-N-phenylamino, N-methylpiperadino), and alkylthio group (e.g., methylthio, ethylthio). The substituent on such a substituted methine group preferably has 1 to 12 carbon atoms. Such a methine group may form a ring with other methine groups or with auxochromes.

$L_{11}$, $L_{12}$, $L_{16}$, $L_{17}$, $L_{18}$, $L_{19}$, $L_{22}$, $L_{23}$, $L_{29}$ and $L_{30}$ each is preferably an unsubstituted methine group.

The suffix $n_{12}$ is preferably an integer 0, 1, 2 or 3.

$L_{13}$, $L_{14}$ and $L_{15}$ form a monomethine dye, trimethine dye, pentamethine dye, heptamethine dye or the like. When $n_{12}$ is 2 or more, $L_{13}$ and $L_{14}$ units are repeated but may not be the same.

Preferred examples of $L_{13}$, $L_{14}$ and $L_{15}$ will be given below.

$$=CH-$$

$$=CH-\overset{\overset{R_{21}}{|}}{C}=CH-$$

-continued

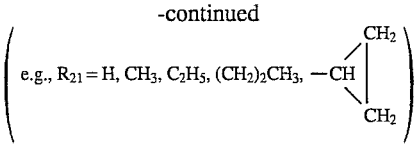

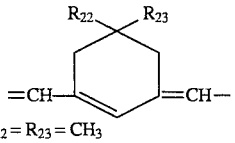

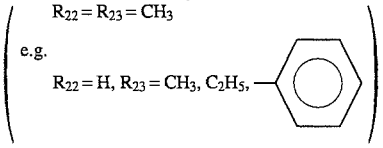

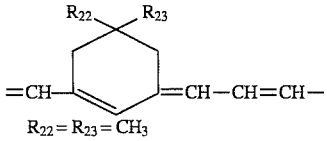

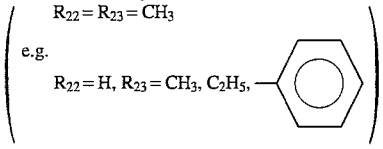

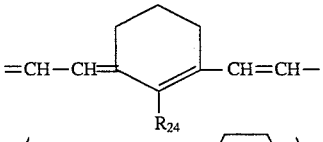

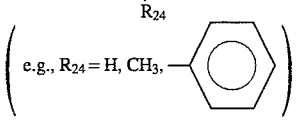

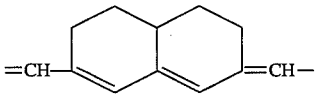

$R_{21}$, $R_{22}$, $R_{23}$, $R_{24}$ = hydrogen atom, alkyl group, aryl group or heterocyclic group The suffix $n_{15}$ is preferably 0, 1, 2 or 3.

$L_{20}$ and $L_{21}$ form a zeromethine, dimethine, tetramethine or hexamethine dye. When $n_{15}$ is 2 or more, $L_{20}$ and $L_{21}$ units are repeated but may not be the same.

Preferred examples of $L_{20}$ and $L_{21}$ will be given below.

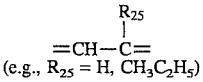

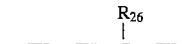

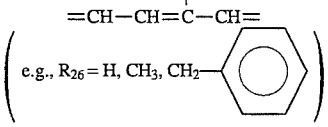

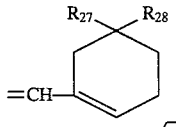

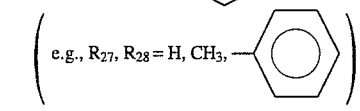

-continued

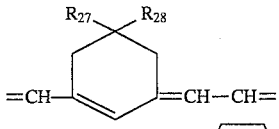

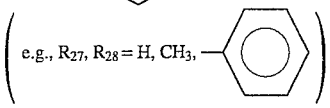

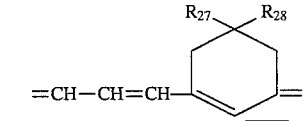

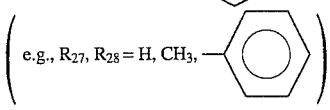

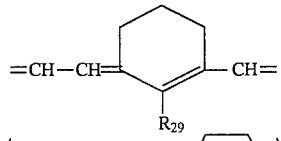

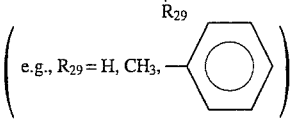

$R_{21}$, $R_{22}$, $R_{23}$, $R_{24}$ = hydrogen atom, alkyl group, aryl group or heterocyclic group The suffix $n_{17}$ is preferably 0, 1, 2 or 3.

$L_{24}$ and $L_{25}$ form a zeromethine, dimethine, tetramethine or hexamethine dye. When $n_{17}$ is 2 or more, $L_{24}$ and $L_{25}$ units are repeated but may not be the same.

Preferred examples of $L_{24}$ and $L_{25}$ are the same as that of $L_{20}$ and $L_{21}$.

The suffix $n_{18}$ is preferably 0, 1, 2 or 3.

$L_{26}$, $L_{27}$ and $L_{28}$ form a monomethine, trimethine, pentamethine or heptamethine dye. When $n_{18}$ is 2 or more, $L_{26}$ and $L_{27}$ units are repeated but may not be the same.

Preferred examples of $L_{26}$, $L_{27}$ and $L_{28}$ will be given below.

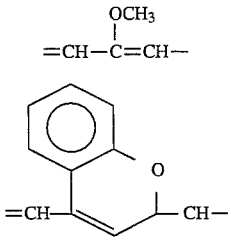

Other preferred examples of $L_{26}$, $L_{21}$ and $L_{28}$ include those given with reference to $L_{13}$, $L_{14}$ and $L_{15}$.

The methine dye structures represented by formulae (II), (III) and (IV) are each substituted by at least one $-(Q)_{k2}-(ST)$. The position at which $-(Q)_{k2}-(ST)$ substitutes for the methine dye structure may be on any of $Z_{11}$, $Z_{12}$, $Z_{13}$, $Z_{14}$, $Z_{15}$, $Z_{16}$, D, D', $R_{11}$, $R_{12}$, $R_{13}$, $R_{14}$, $R_{15}$, $R_{16}$, and $L_1$ to $L_{30}$. Preferably, it is on a group represented by $R_{11}$, $R_{12}$, $R_{13}$, $R_{14}$, $R_{15}$ or $R_{16}$.

More preferred among the compounds represented by formula (II) are those represented by formulae (V) and (VI):

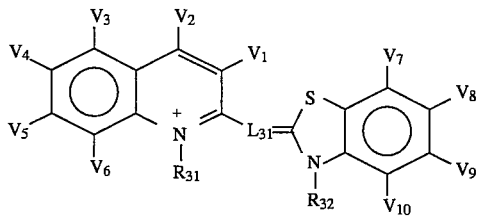

(V)

$M_{14}m_{14}$

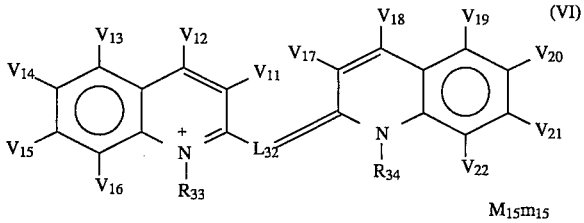

(VI)

$M_{15}m_{15}$

In the formulae, $R_{31}$, $R_{32}$, $R_{33}$ and $R_{34}$ each represents a substituted or unsubstituted alkyl group. $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, and $V_{22}$ each represent a hydrogen atom or monovalent substituent.

$L_{31}$ and $L_{32}$ each represents a substituted or unsubstituted methine group.

$M_{14}$ and $M_{15}$ each represents a charge-neutralizing paired ion. The suffixes $m_{14}$ and $m_{15}$ each represents a number of 0 or more necessary for the neutralization of electric charge in the molecule.

However, the compounds represented by formulae (V) and (VI) are each substituted by at least one $—(Q)_{k2}—(ST)$.

Formulae (V) and (VI) will be further described hereinafter.

Preferred examples of $R_{31}$, $R_{32}$, $R_{33}$ and $R_{34}$ are the same as $R_{11}$, $R_{12}$, $R_{13}$, $R_{14}$ and $R_{16}$.

$V_1$ to $V_{22}$ each represents a hydrogen atom or a monovalent substituent. As such a monovalent substituent there may be used any substituent. Preferred examples of such a substituent will be given below.

Preferred examples of such a substituent include unsubstituted alkyl group (e.g., methyl, ethyl, propyl, isopropyl, butyl, isobutyl, hexyl, octyl, dodecyl, octadecyl, cyclopentyl, cyclopropyl, cyclohexyl), and substituted alkyl group. If the substituent on the substituted alkyl group is V, the substituent represented by V is not specifically limited. Examples of such a substituent include carboxyl group, sulfo group, cyano group, halogen atom (e.g., fluorine, chlorine, bromine, iodine), hydroxyl group, alkoxycarbonyl group (e.g., methoxycarbonyl, ethoxycarbonyl, phenoxycarbonyl, benzyloxycarbonyl), alkoxy group (e.g., methoxy, ethoxy, benzyloxy, phenethyloxy), aryloxy group having 18 or less carbon atoms (e.g., phenoxy, 4-methylphenoxy, α-naphthoxy), acyloxy group (e.g., acetyloxy, propionyloxy), acyl group (e.g., acetyl, propionyl, benzoyl, mesyl), carbamoyl group (e.g., carbamoyl, N,N-dimethylcarbamoyl, morpholinocarbonyl, piperidinocarbonyl), sulfamoyl group (e.g., sulfamoyl, N,N-dimethylsulfamoyl, morpholinosulfonyl, piperidinosulfonyl), aryl group (e.g., phenyl, 4-chlorophenyl, 4-methylphenyl, α-naphthyl), heterocyclic group (e.g., 2-pyridyl, tetrahydrofurfuryl, morpholino, 2-thiopheno), amino group (e.g., amino, dimethylamino, anilino, diphenylamino), alkylthio group (e.g., methylthio, ethylthio), alkylsulfonyl group (e.g., methylsulfonyl, propylsulfonyl), alkylsulfinyl group (e.g., methylsulfinyl), nitro group, phosphoric group, acylamino group (e.g., acetylamino), ammonium group (e.g., trimethylammonium, tributylammonium), mercapto group, hydrazino group (e.g., trimethylhydrazino), ureide group (e.g., ureide, N,N-dimethylureide), imide group, and unsaturated hydrocarbon group (e.g., vinyl, ethynyl, 1-cyclohexenyl, benzylidine, benzylidene). The number of carbon atoms contained in the substituent V is preferably not more than 18. V may further substitute on these substituents.

Other examples of such a substituent include unsubstituted aryl group (e.g., phenyl, 1-naphthyl), substituted aryl group (examples of substituents on such a substituted aryl group include the foregoing substituents V), unsubstituted heterocyclic group (e.g., 2-pyridyl, 2-thiazolyl, morpholino, 2-thiopheno), substituted heterocyclic group (examples of substituents on such a substituted aryl group include the foregoing substituents V), and the foregoing substituents V.

Specific examples of such a substituents for $V_1$ to $V_{22}$ include alkyl group (e.g., methyl, ethyl, carboxymethyl, 2 -carboxyethyl, 3-carboxypropyl, 4-carboxybutyl, sulfomethyl, 2 -sulfoethyl, 3-sulfopropyl, 4-sulfobutyl, 3-sulfobutyl, 2 -hydroxy-3-sulfopropyl, 2-cyanoethyl, 2-chloroethyl, 2-bromoethyl, 2-hydroxyethyl, 3-hydroxypropyl, hydroxymethyl, 2-hydroxyethyl, 4-hydroxybutyl, 2,4-dihydroxybutyl, 2-methoxyethyl, 2-ethoxyethyl, methoxyethyl, 2-ethoxycarbonylethyl, methoxycarbonylmethyl, 2-methoxyethyl, 2-ethoxyethyl, 2 -phenoxyethyl, 2-acetyloxyethyl, 2-propionyloxyethyl, 2 -acetylethyl, 3-benzoylpropyl, 2-carbamoylethyl, 2-morpholinocarbonylethyl, sulfamoylmethyl, 2-(N,N-dimethylsulfamoyl)ethyl, benzyl, 2-naphthylethyl, 2-(2-pyridyl)ethyl, allyl, 3 -aminopropyl, dimethylaminomethyl, 3-diethylaminopropyl, methylthiomethyl, 2-methylsulfonylethyl, methylsulfinylmethyl, 2-acetylaminoethyl, acetylaminomethyl, trimethylammoniumethyl, 2-mercaptoethyl, 2-trimethylhydrazinoethyl, methylsulfonylcarbamoylmethyl, (2-methoxy)ethoxymethyl)), aryl group (e.g., phenyl, 1-naphthyl, p-chlorophenyl), heterocyclic group (e.g., 2-pyridyl, 2-thiazolyl, 4-phenyl-3-thiazolyl), and substituents represented by V (preferably carboxyl group, chloro group, bromo group, formyl group, acetyl group, benzoyl group, 3 -carboxypropanonyl group, 3-hydroxypropanoyl group, chlorine atom, N-phenylcarbamoyl group, N-butylcarbamoyl group, boric group, sulfo group, cyano group, hydroxyl group, methoxy group, methoxycarbonyl group, acetyloxy group, dimethylamino group).

Adjacent two of $V_1$ to $V_{22}$ may be connected to each other to form rings. These rings may be aliphatic or aromatic. These rings may be substituted by, e.g., the foregoing substituents V.

The methine dye structures represented by formulae (V) and (VI) are each substituted by at least one $—(Q)_{k2}—(ST)$. The position at which $—(Q)_{k2}—(ST)$ substitutes for the methine dye structure may be on any of $R_{31}$, $R_{32}$, $R_{33}$, $R_{34}$, $V_1$ to $V_{22}$, and $L_{32}$. Preferably, it is on any of the groups represented by $R_{31}$, $R_{32}$, $R_{33}$ and $R_{34}$.

The styryl base structure which may be preferably used as ST in the present invention is preferably represented by formula (VII):

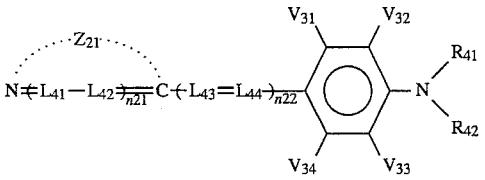

(VII)

wherein $Z_{21}$ represents an atomic group necessary for the formation of a 5- or 6-membered nitrogen-containing heterocyclic group.

$V_{31}$, $V_{32}$, $V_{33}$ and $V_{34}$ each represents a hydrogen atom or monovalent substituent. $R_{41}$ and $R_{42}$ each represents an alkyl group, aryl group or heterocyclic group. $L_{41}$, $L_{42}$, $L_{43}$ and $L_{44}$ each represents a methine group. $n_{21}$ represents 0 or 1. $n_{22}$ represents 1, 2 or 3. However, the styryl base structure represented by formula (VII) is substituted by at least one $—(Q)_{k2}—(MET)_{k1}$.

Formulae (A) and (VII) will be further described hereinafter.

$Z_{21}$ has the same meaning as $Z_{11}$, $Z_{12}$, $Z_{13}$, $Z_{14}$ and $Z_{16}$. Particularly preferred among these nuclei are benzoxazole nucleus, naphthoxazole nucleus, benzothiazole nucleus and naphthothiazole nucleus. $V_{31}$, $V_{32}$, $V_{33}$, $V_{34}$ and $V_{35}$ have the same meaning as $V_1$ to $V_{22}$.

$R_{41}$ and $R_{42}$ have the same meaning as $R_{15}$. Particularly preferred among these substituents are unsubstituted or substituted alkyl groups represented by $R_{15}$.

$L_{41}$, $L_{42}$, $L_{43}$ and $L_{44}$ are preferably the same as $L_{11}$ to $L_{30}$. Particularly preferred among these substituents are unsubstituted alkyl groups.

$n_{22}$ preferably represents 1 or 2, more preferably 1.

The styryl base structure represented by formulae (VII) is substituted by at least one $—(Q)_{k2}—(MET)_{k1}$. The position at which $—(Q)_{k2}—(MET)_{k1}$ substitutes for the styryl base structure may be on any of $Z_{21}$, $V_{31}$, $V_{32}$, $V_{34}$, $R_{41}$, $R_{42}$, $L_{41}$, $L_{42}$, $L_{43}$ and $L_{44}$. Preferably, it is on a group represented by $Z_{21}$, $R_{41}$ or $R_{42}$. More preferably, it is on a group represented by $RR_{41}$ or $R_{42}$.

In the structure represented by formula (I), the oxidation potential of ST is lower than that of MET.

Typical examples of the compound represented by formula (I) will be given below, but the present invention should not be construed as being limited thereto.

(1) Compound having a methine dye represented by formula (II) and a styryl base represented by formula (VII) covalently bonded to each other (excluding the methine dye structure represented by formulae (V) and (VI))

(II-1)

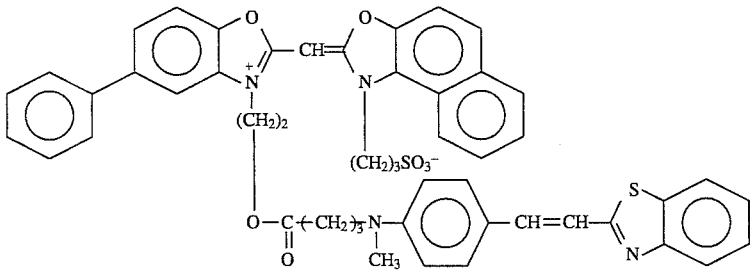

(II-2)

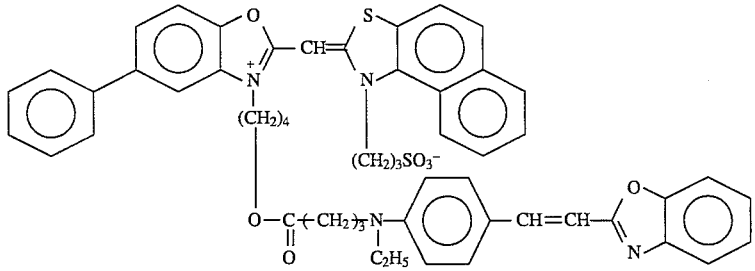

(II-3)

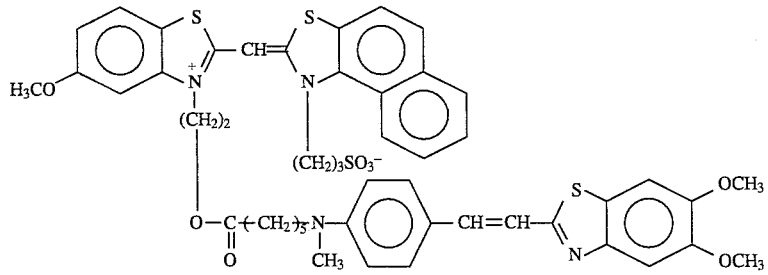

-continued
(II-4)
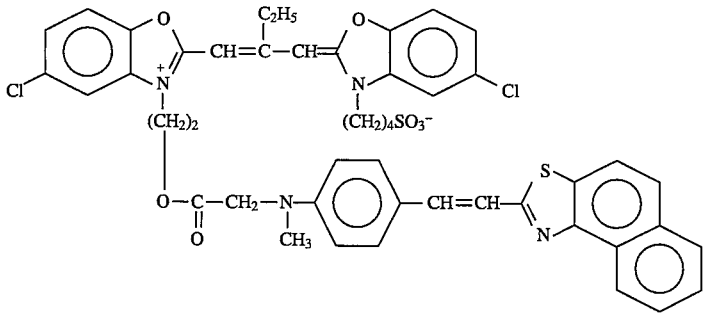
(II-5)
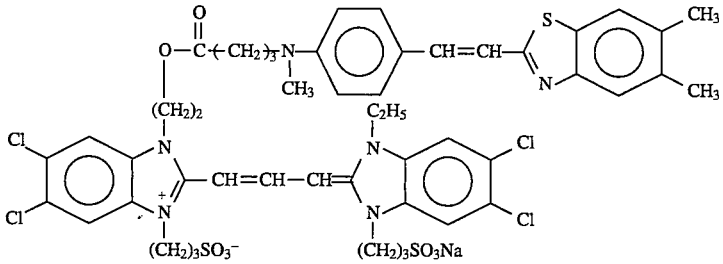
(II-6)
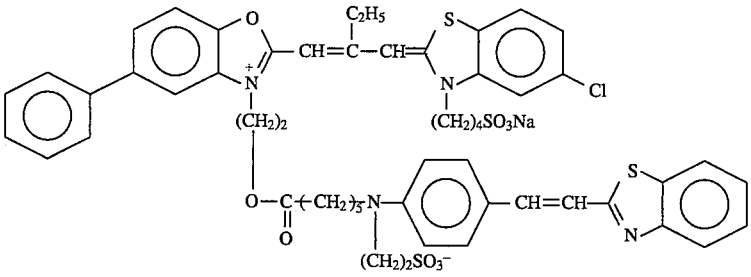
(II-7)
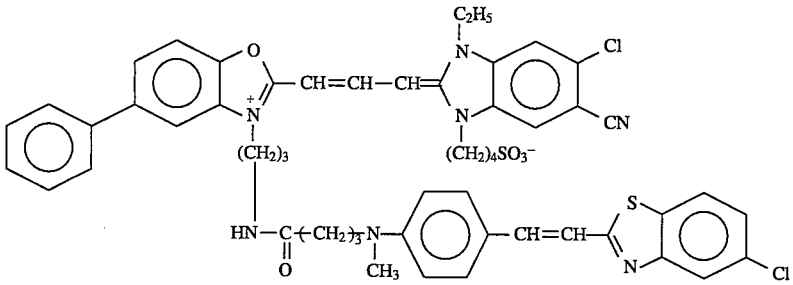
(II-8)
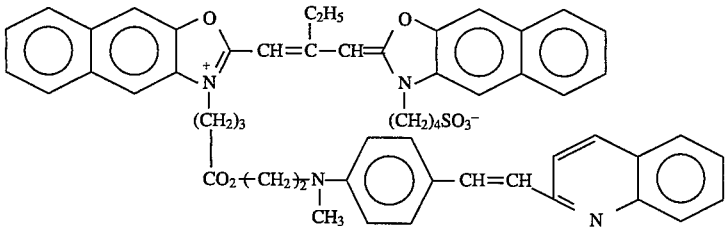

-continued
(II-9)
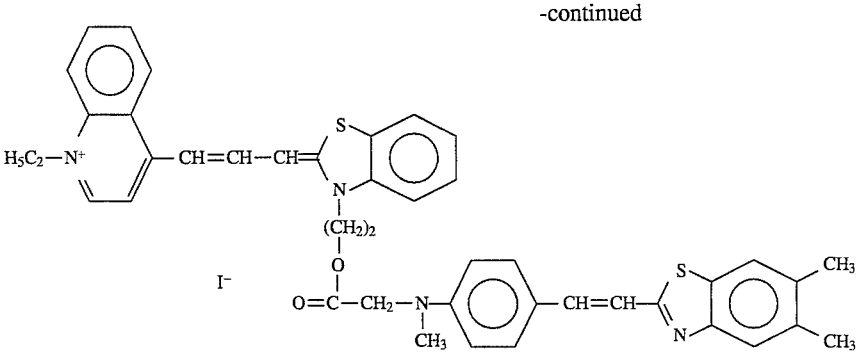
(II-10)
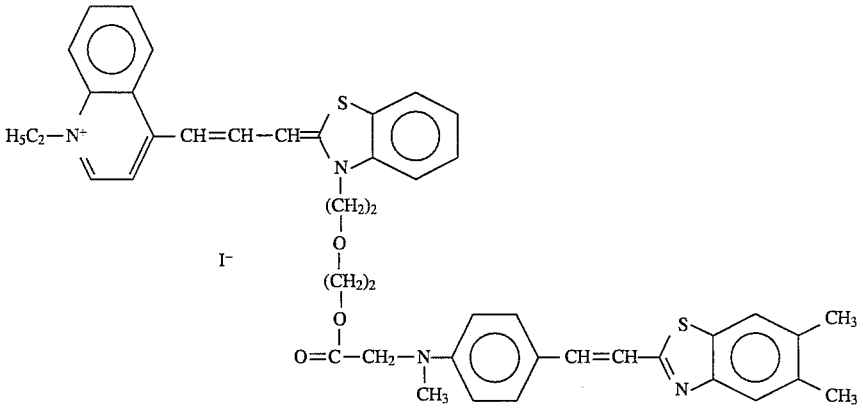
(II-11)
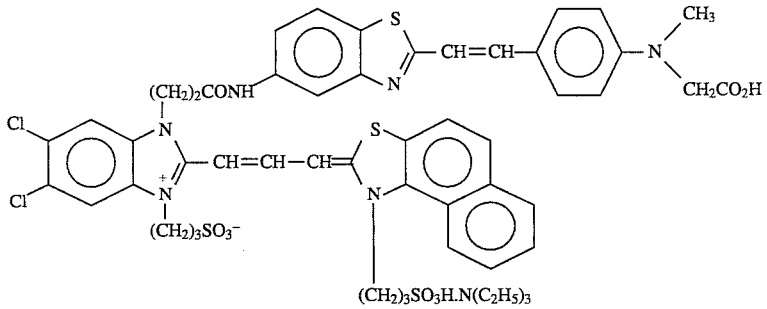
(II-12)
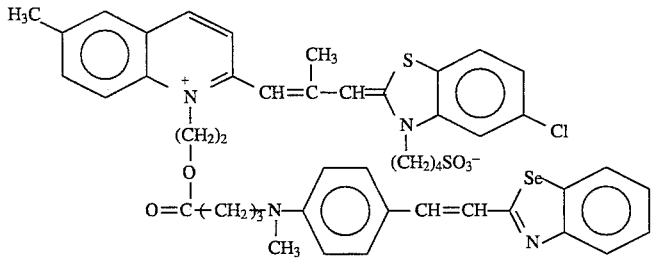
(II-13)
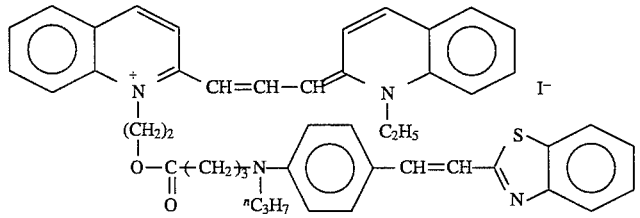

-continued
(II-14)
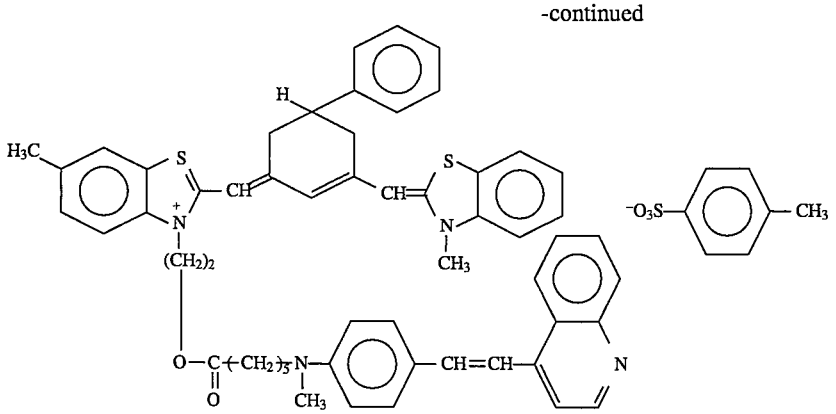
(II-15)
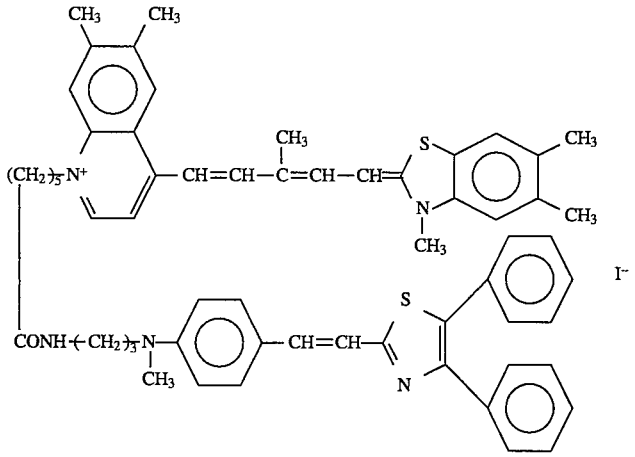
(II-16)
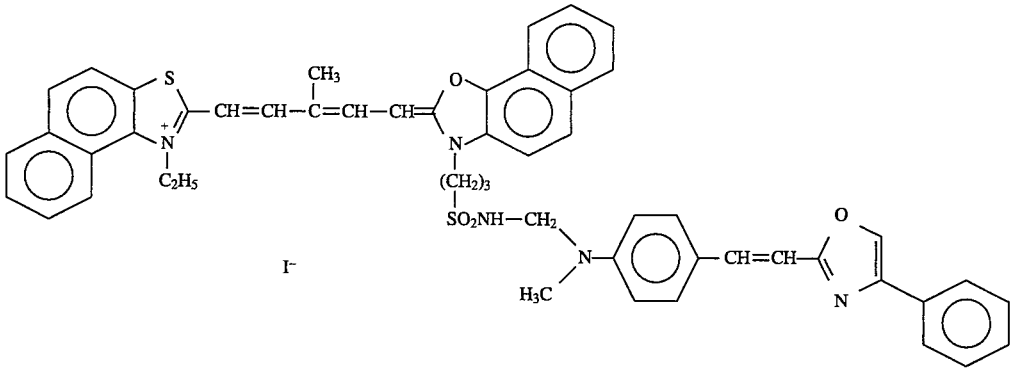
(II-17)
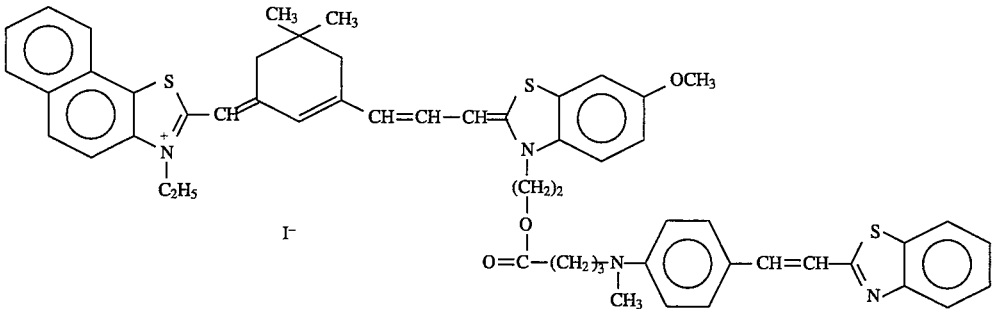

-continued
(II-18)
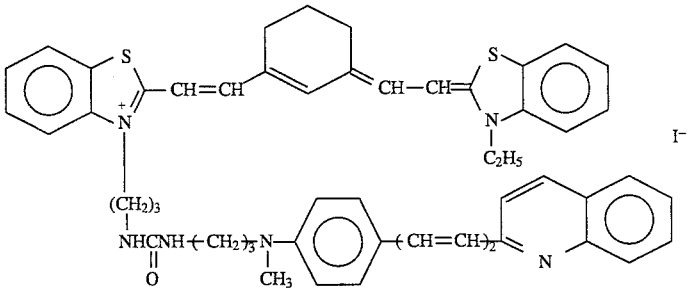
(II-19)
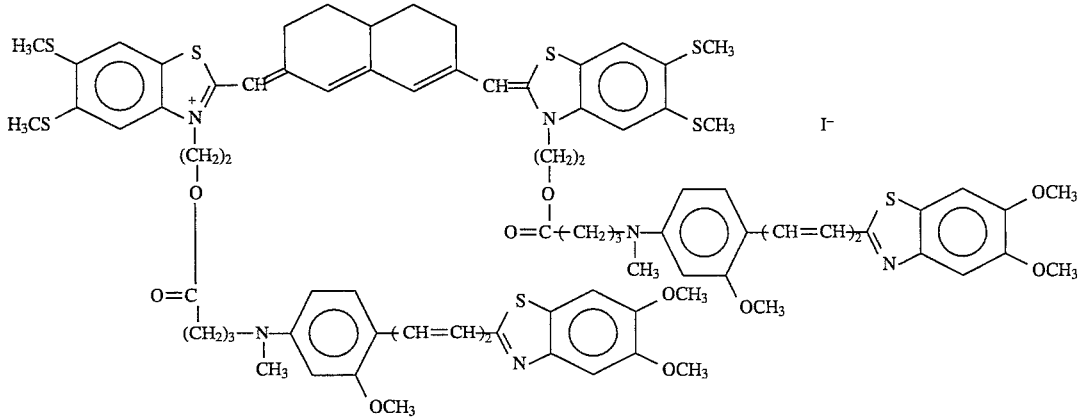
(II-20)
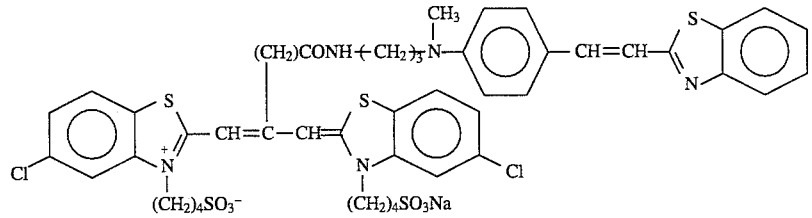
(II-21)
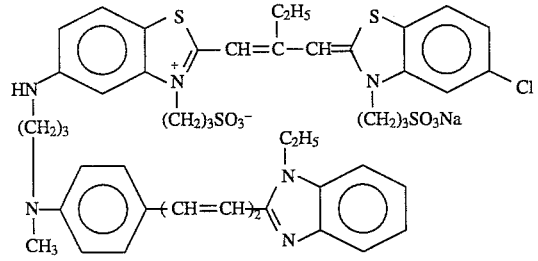
(II-22)
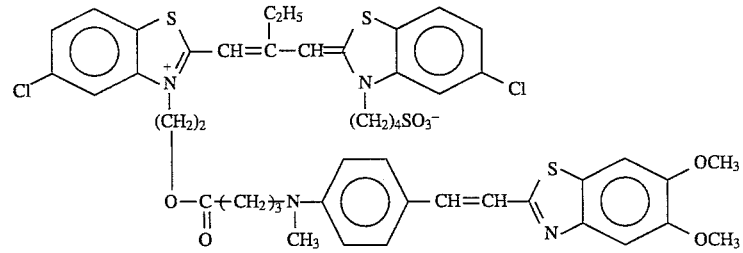

-continued
(II-23)
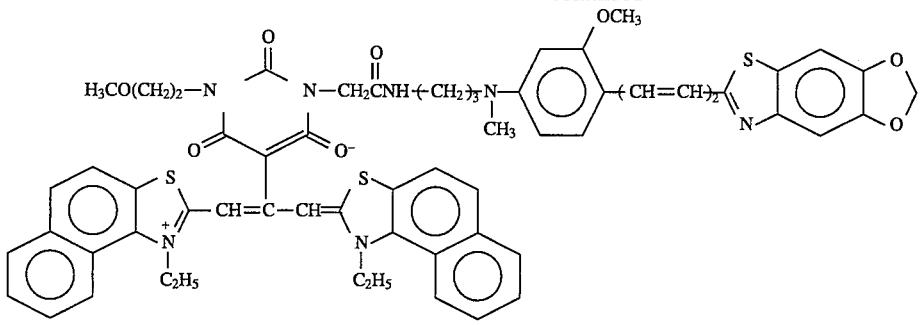
(2) Compound having a methine dye represented by formula (III) and a styryl base represented by formula (VII) covalently bonded to each other
(III-1)
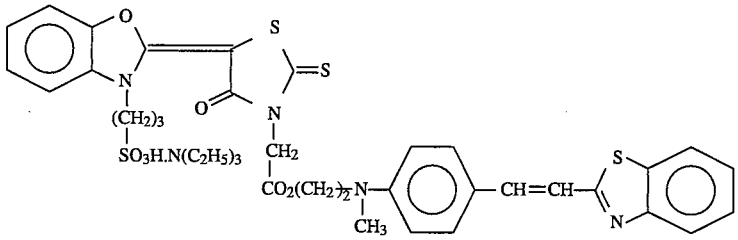
(III-2)
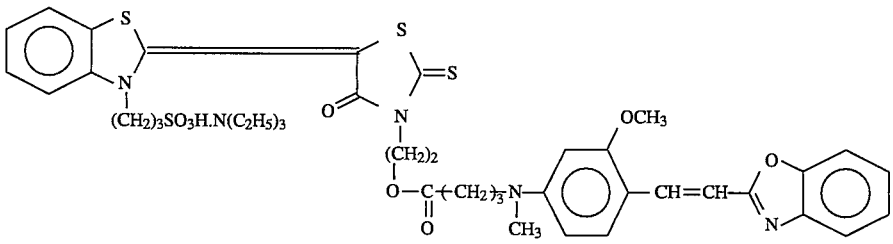
(III-3)
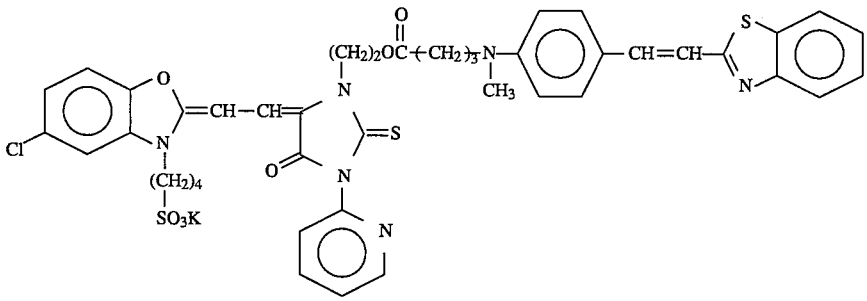
(III-4)
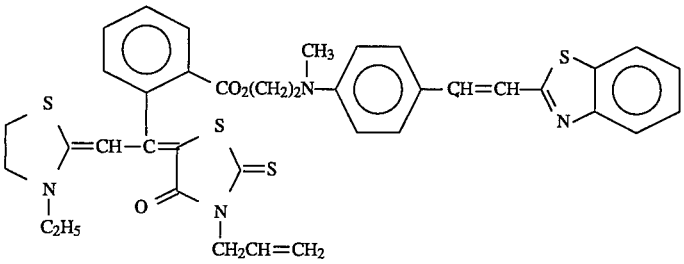

-continued
(III-5)
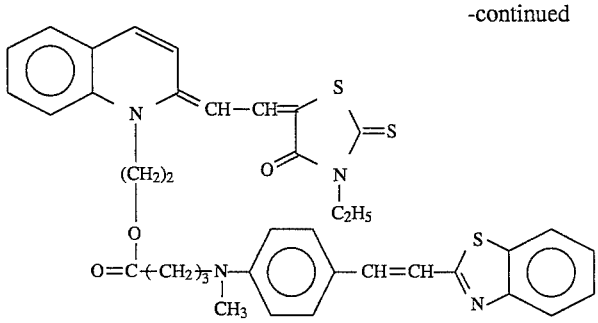
(III-6)
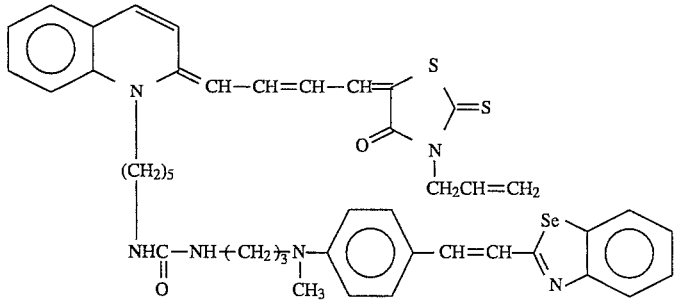
(III-7)
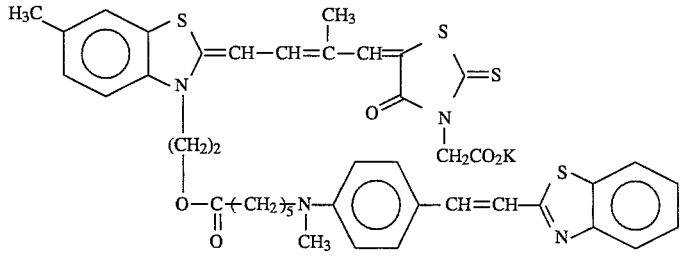
(III-8)
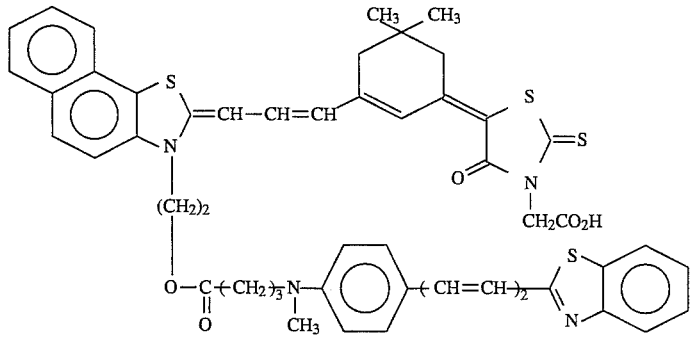
(3) Compound having a methine dye represented by formula (IV) and a styryl base represented by formula (VII) covalently bonded to each other
(IV-1)
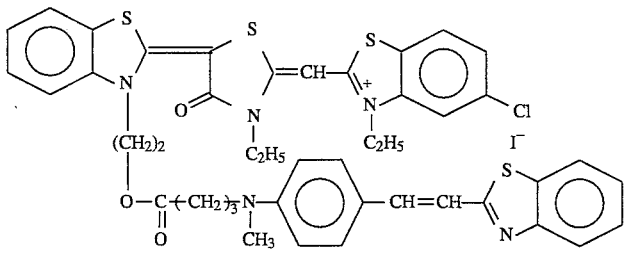

-continued
(IV-2)
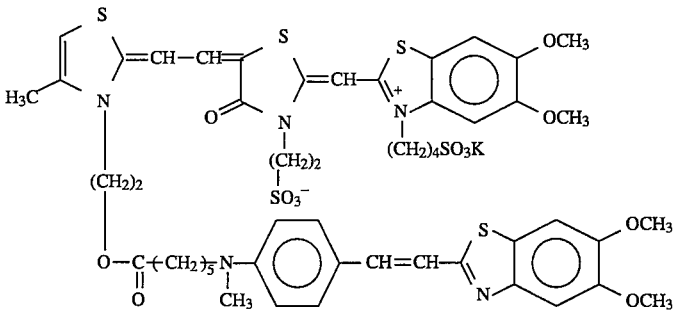
(IV-3)
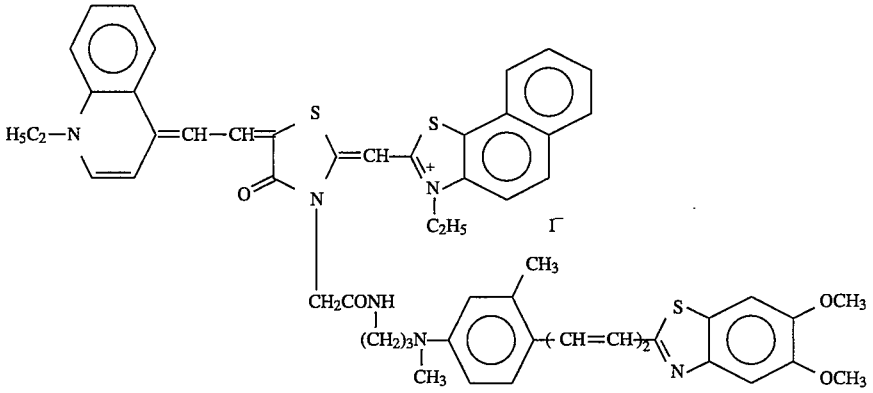
(IV-4)
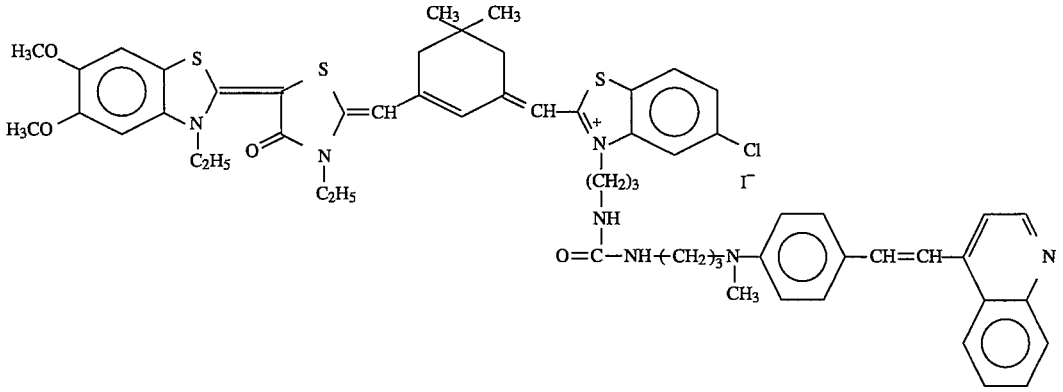
(IV-5)
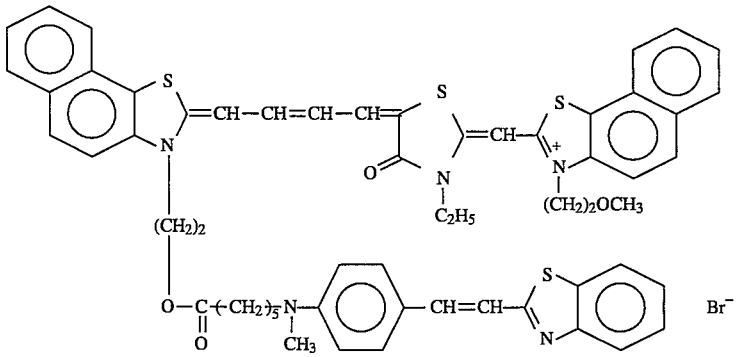

-continued
(IV-6)
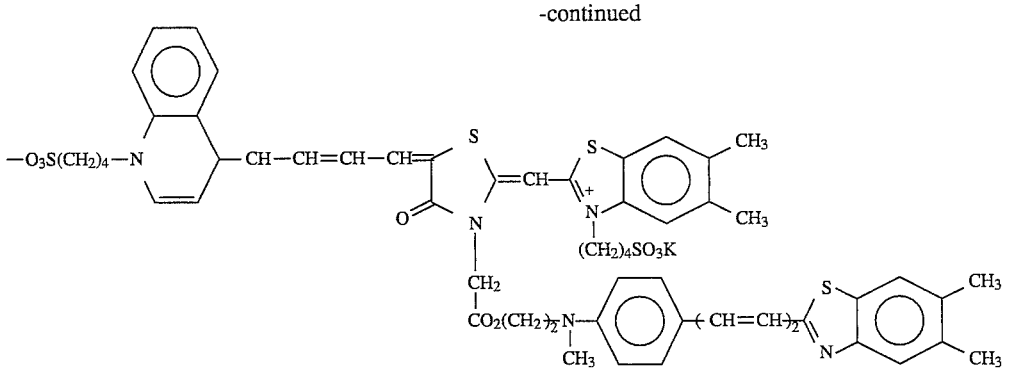
(IV-7)
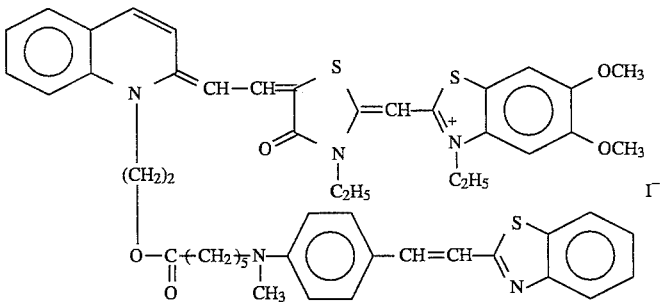
(4) Compound having a methine dye represented by formula (V) and a styryl base represented by formula (VII) covalently bonded to each other
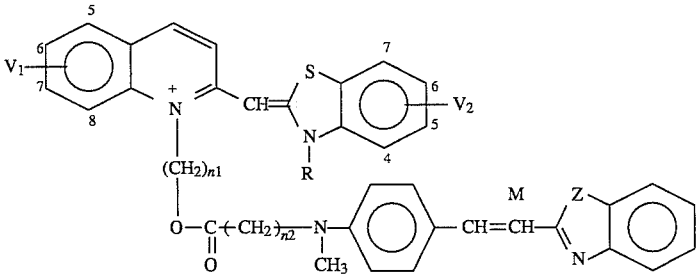
| Compound No. | V1 | V2 | R | n1 | n2 | Z | M |
|---|---|---|---|---|---|---|---|
| (V-1) | 6-$CH_3$ | 5-Cl | $C_2H_5$ | 2 | 3 | S | $I^-$ |
| (V-2) | H | " | " | " | " | " | $Br^-$ |
| (V-3) | " | " | " | " | 5 | " | " |
| (V-4) | " | " | " | " | 3 | O | " |
| (V-5) | " | 5-Br | " | " | " | Se | " |
| (V-6) | " | 5-Cl | " | 4 | 3 | S | " |
| (V-7) | " | " | $(CH_2)_4SO_3^-$ | 2 | " | " | — |
| (V-8) | 6-$OCH_3$ | 5-$OCH_3$ | $C_2H_5$ | " | " | " | $Br^-$ |
| (V-9) | 6,7-$(CH_3)_2$ | 5-$CF_3$ | $(CH_2)_3SO_3^-$ | " | 5 | O | — |
| (V-10) | 6-$CH_3$ | 5-Ph | $CH_3$ | " | 1 | S | $I^-$ |
(V-11)
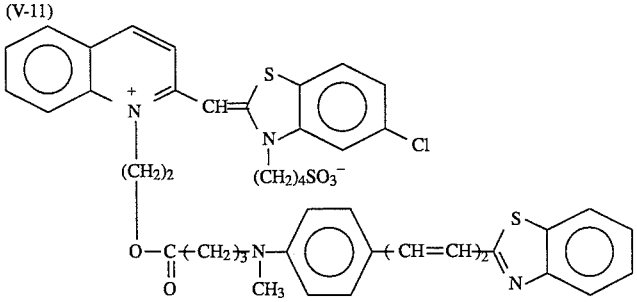

-continued
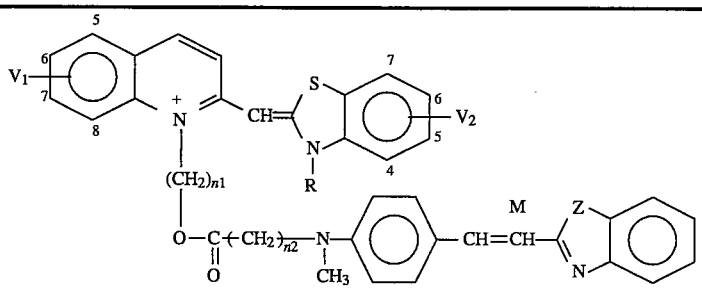
| Compound No. | V1 | V2 | R | n1 | n2 | Z | M |
|---|---|---|---|---|---|---|---|
| (V-1) | 6-$CH_3$ | 5-Cl | $C_2H_5$ | 2 | 3 | S | $I^-$ |
| (V-2) | H | " | " | " | " | " | $Br^-$ |
| (V-3) | " | " | " | " | 5 | " | " |
| (V-4) | " | " | " | " | 3 | O | " |
| (V-5) | " | 5-Br | " | " | " | Se | " |
| (V-6) | " | 5-Cl | " | 4 | 3 | S | " |
| (V-7) | " | " | $(CH_2)_4SO_3^-$ | 2 | " | " | — |
| (V-8) | 6-$OCH_3$ | 5-$OCH_3$ | $C_2H_5$ | " | " | " | $Br^-$ |
| (V-9) | 6,7-$(CH_3)_2$ | 5-$CF_3$ | $(CH_2)_3SO_3^-$ | " | 5 | O | — |
| (V-10) | 6-$CH_3$ | 5-Ph | $CH_3$ | " | 1 | S | $I^-$ |
(V-12)
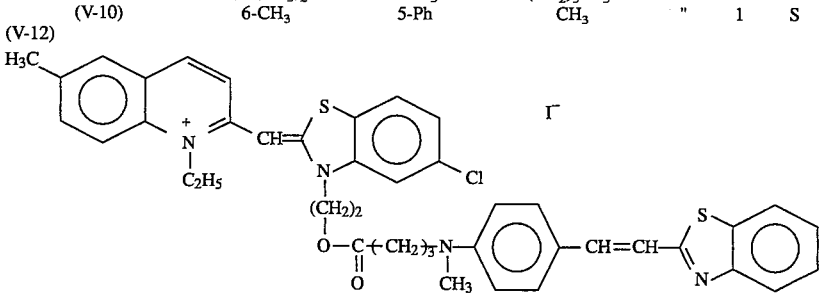
(V-13)
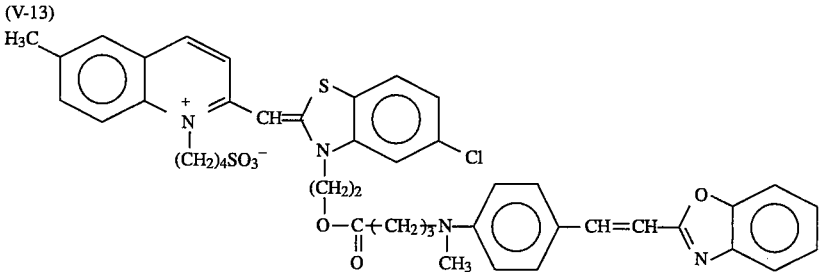
(V-14)
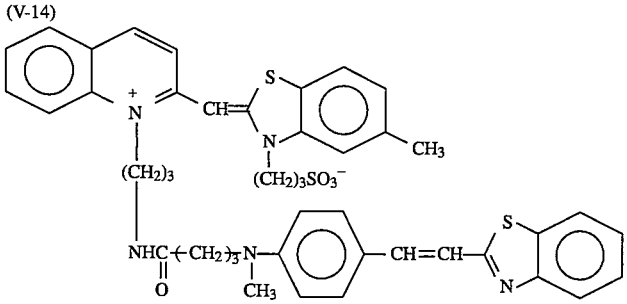
(V-15)
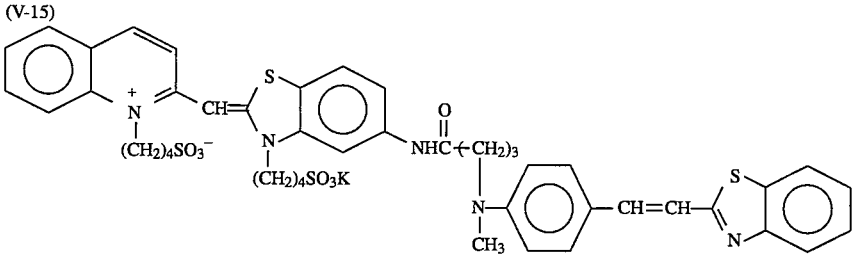

-continued
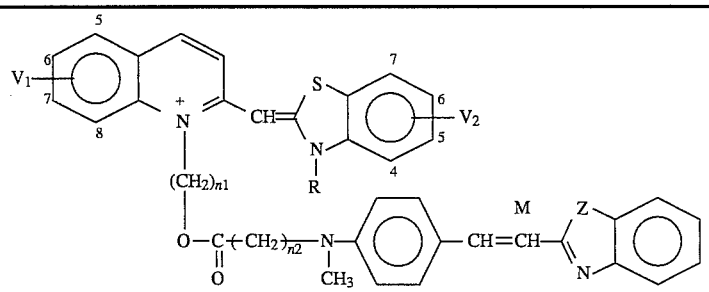
| Compound No. | V1 | V2 | R | n1 | n2 | Z | M |
|---|---|---|---|---|---|---|---|
| (V-1) | 6-$CH_3$ | 5-Cl | $C_2H_5$ | 2 | 3 | S | $I^-$ |
| (V-2) | H | " | " | " | " | " | $Br^-$ |
| (V-3) | " | " | " | " | 5 | " | " |
| (V-4) | " | " | " | " | 3 | O | " |
| (V-5) | " | 5-Br | " | " | " | Se | " |
| (V-6) | " | 5-Cl | " | 4 | 3 | S | " |
| (V-7) | " | " | $(CH_2)_4SO_3^-$ | 2 | " | " | — |
| (V-8) | 6-$OCH_3$ | 5-$OCH_3$ | $C_2H_5$ | " | " | " | $Br^-$ |
| (V-9) | 6,7-$(CH_3)_2$ | 5-$CF_3$ | $(CH_2)_3SO_3^-$ | " | 5 | O | — |
| (V-10) | 6-$CH_3$ | 5-Ph | $CH_3$ | " | 1 | S | $I^-$ |
(V-16)
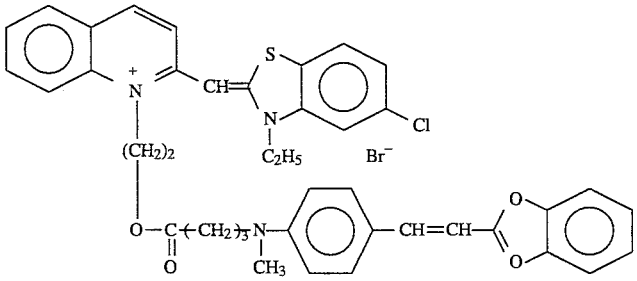
(5) Compound having a methine dye represented by formula (VI) and a styryl base represented by formula (VII) covalently bonded to each other
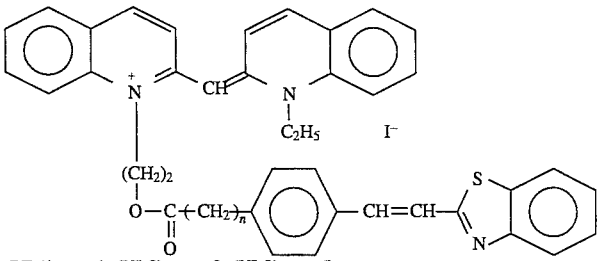
(VI-1) n = 1 (VI-2) n = 3 (VI-3) n = 5
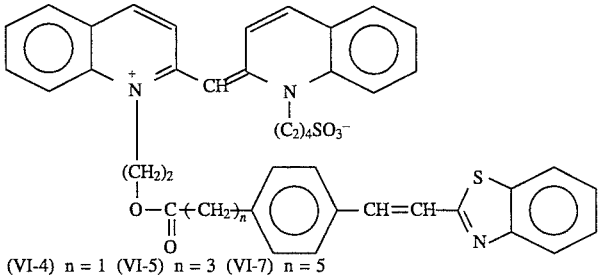
(VI-4) n = 1 (VI-5) n = 3 (VI-7) n = 5

-continued
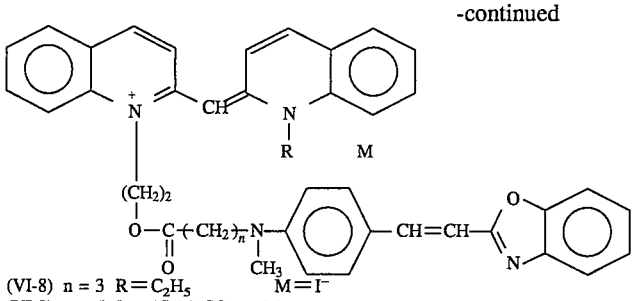
(VI-8) n = 3 R = $C_2H_5$ M = $I^-$
(VI-9) n = 5 R = $(CH_2)_4SO_3^-$ M = –
(VI-10)
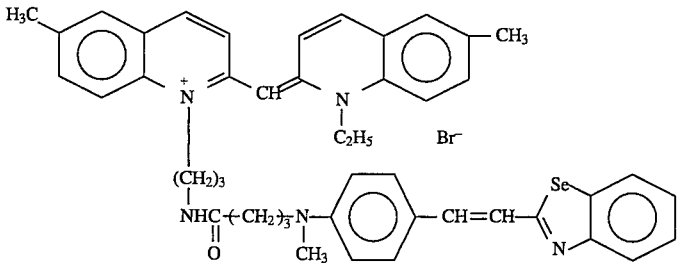
(VI-11)
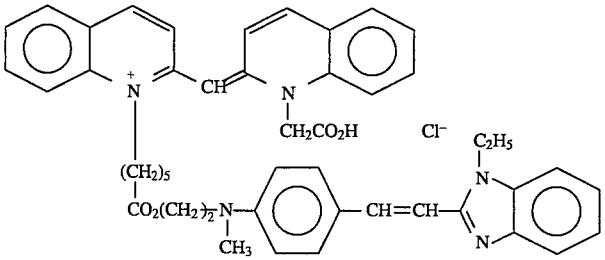
(VI-12)
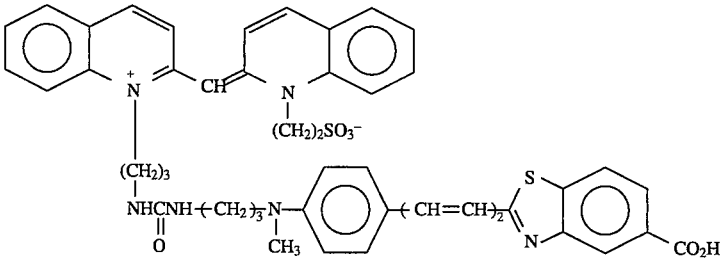
(VI-13)
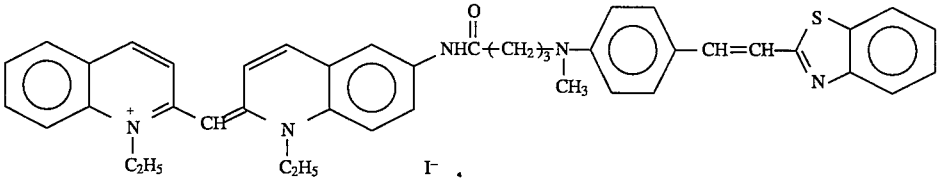
(6) Others
(A)

-continued

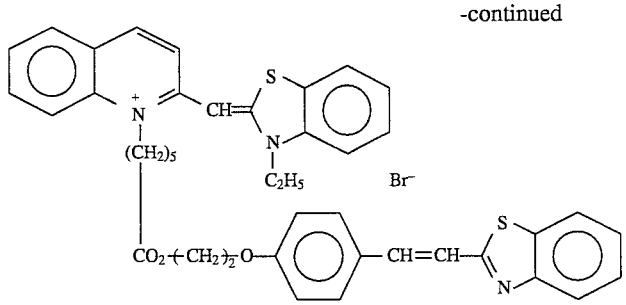

(B)

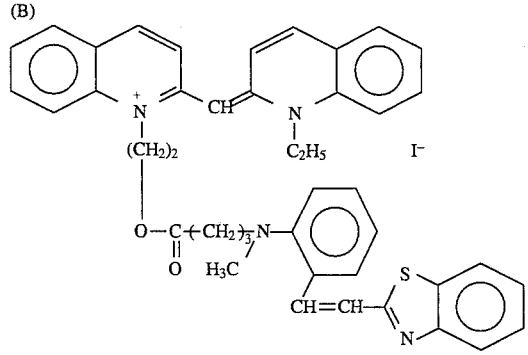

Of them, compounds (V-1), (V-2) and (V-3) are preferable.

The synthesis of MET and ST structures in the general formula (I) to be used in the present invention can be accomplished by any proper method as disclosed in F. M. Hamer, *"Heterocyclic Compounds-Cyanine Dyes and Related Compounds"*, John Wiley & Sons, New York, London, 1964, D. M. Sturmer, *"Heterocyclic Compounds-Special topics in heterocyclic chemistry"*, Chapter 18, Section 14, pp. 482–515, John Wiley & Sons, New York, London, 1977, *"Rodd's Chemistry of Carbon Compounds"*, 2nd Ed., vol. IV, part B, 1977, chapter 15, pp. 369–422, 2nd Ed., vol. IV, part B, 1985, chapter 15, pp. 267–296, Elsvier Science Publishing Company Inc., New York, etc.

The bond formation reaction such as amide bond formation reaction and ester bond formation reaction of —$(Q)_{k2}$—(ST) moiety can be accomplished by any method as known in organic chemistry. In some detail, a method which comprises the connection of MET to ST, a method which comprises the connection of ST to a synthesis starting material and intermediate of polymethine dye followed by reaction for conversion to dye, a method which comprises the connection of a synthesis starting material and intermediate of ST to a polymethine dye moiety followed by the synthesis of ST, or like method can be properly selected. For details of synthesis reaction for connection, reference can be made to "Shinjikken Kagaku Koza 14 (New Institute of Experimental Chemistry 14)—Yuki Kagobutu no Gosei to Hannou (Synthesis and Reaction of Organic Compounds)", Chemical Society of Japan, vols. I–V, Maruzen, Tokyo, 1977, Yoshio Ogata, *"Organic Chemistry"*, Maruzen, Tokyo, 1962, L. F. Fieser and M. Fieser, *"Advanced Organic Chemistry"*, Maruzen, Tokyo, 1962, and many other handbooks of organic synthesis reaction.

The reaction will be further described in Examples 1 to 6.

The compound represented by formula (I) according to the present invention may be used singly but preferably in combination with other spectral sensitizing dyes. As such spectral sensitizing dyes there may be preferably used cyanine dyes (dyes having a structure represented by formula (II) wherein $(Q)_{k2}$—(ST) is not substituted), melocyanine dyes (dyes having a structure represented by formula (III) wherein $(Q)_{k2}$—(ST) is not substituted), and rhodacyanine dyes (dyes having a structure represented by formula (IV) wherein $(Q)_{k2}$—(ST) is not substituted). Further, allopolar dyes, hemicyanine dyes, oxonol dyes, hemioxonol dyes, and styryl dyes can be preferably used.

More preferably, the compound represented by formula (I) may be used in combination with a dye having the similar or same structure as MET moiety of the compound wherein $(Q)_{k2}$—(ST) is not substituted.

The compound of the present invention and the sensitizing dye to be used in the present invention may be incorporated in the silver halide emulsion of the present invention in the form of direct dispersion or in the form of solution in water, methanol, ethanol, propanol, acetone, methylcellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., singly or in admixture.

Alternatively, a method which comprises dissolving a dye or the like in a volatile organic solvent, dispersing the solution in water or a hydrophilic colloid, and then adding the dispersion in an emulsion as described in U.S. Pat. No. 3,469,987, a method which comprises dispersing a water-insoluble dye or the like in a water-soluble solvent without dissolving, and then adding the dispersion to an emulsion as described in JP-B-46-24185 (The term "JP-B" as used herein means an "examined Japanese patent publication"), a method which comprises dissolving a dye or the like in an acid, and then adding the solution to an emulsion, or dissolving a dye or the like in water in the presence of an acid or base, and then adding the aqueous solution to an emulsion as described in JP-B-44-23389, JP-B-44-27555, and JP-B-57-22091, a method which comprises preparing an aqueous solution or colloidal dispersion of a dye or the like in the presence of a surface active agent, and then adding the aqueous solution or colloidal dispersion to an emulsion as described in U.S. Pat. Nos. 3,822,135 and 4,006,026, a method which comprises directly dispersing a dye or the like in a hydrophilic colloid, and then adding the dispersion to an emulsion as described in JP-A-53-102733 and JP-A-58-105141, and a method which comprises dissolving a dye or the like with a compound for making red shift, and then adding the solution to an emulsion as described in JP-A-51-74624 can be used.

Further, the dissolution of the dye can be effected with the aid of ultrasonic wave.

The time during which the sensitizing dye to be used in the present invention or the compound represented by formula (I) is added to the silver halide emulsion of the present invention may be any step in the preparation of the emulsion which has been heretofore considered useful. For example, the sensitizing dye may be added to the system during the formation of silver halide grains and/or before or during the desalting and/or between after the desalting and before the beginning of the chemical ripening as disclosed in U.S. Pat. Nos. 2,735,766, 3,628,960, 4,183,756, and 4,225,666, JP-A-58-184142, and JP-A-60-196749. Alternatively, the sensitizing dye may be added to the system shortly before or during the chemical ripening or at any step between the chemical ripening and the coating of the emulsion as disclosed in JP-A-58-113920. Further, a sensitizing dye compound of the present invention may be added to the system singly or in combination with compounds having different kinds of structures batchwise during the formation of grains and during or after the chemical ripening or before and during the chemical ripening and after the chemical ripening as disclosed in U.S. Pat. No. 4,225,666 and JP-A-58-7629. The compounds to be batchwise added and the combination of compounds to be added may be altered properly.

The optimum amount of the sensitizing dye of the present invention to be added is in the range of $4\times10^{-8}$ to $8\times10^{-2}$ mol per mol of silver halide, though depending on the shape and size of silver halide grains.

The compound represented by formula (I) is preferably added to the silver halide emulsion in an amount of $1\times10^{-6}$ to $5\times10^{-1}$ mol, more preferably $1\times10^{-5}$ to $2\times10^{-2}$ mol per mol of silver halide, regardless of when it is added, i.e., before or after the sensitizing dye.

The molar proportion of the sensitizing dye to the compound represented by formula (I) may be in any range but is advantageously in the range of 1000/1 to 1/1000, particularly 100/1 to 1/10.

The silver halide employable in the present invention may be any of silver chloride, silver bromide, silver iodide, silver bromochloride, silver iodochloride, silver bromochloroiodide and silver bromoiodide. The silver halide emulsion employable in the present invention may comprise one of these silver halides or a plurality of these silver halides in admixture. The silver halide grain may differ in phase from core to shell, or may have a multi-layer structure having junctions, or may have a localized phase on the surface thereof, or may have a uniform phase throughout its entire depth. Further, these structures may be present in admixture.

The silver halide grain to be used in the present invention may be either monodisperse or polydisperse. The silver halide grain to be used in the present invention may have a regular crystal form such as cube, octahedron and tetradecahedron, an irregular crystal form, or composite thereof. Alternatively, a tabular silver halide grain comprising AgX grains having an aspect ratio (diameter of silver halide grain in circle equivalence/thickness of grain) of not less than 3 in a proportion of not less than 50% based on the total projected area of grain may be used. The aspect ratio of the tabular silver halide grains is preferably not less than 5 or 8. The emulsion may comprise the foregoing various crystal forms in admixture. These emulsions may be of the surface latent image type in which a latent image is formed mainly on the surface thereof or the internal latent image type in which a latent image is formed inside the grain.

The preparation of photographic emulsion to be used in the present invention can be accomplished by any suitable method as disclosed in P. Glafkides, *"Chimie et Physique Photographique"*, Paul Montel, 1967, G. F. Duffin, *"Photographic Emulsion Chemistry"*, The Focal Press, 1966, V. L. Zelikman et al., *"Making and Coating Photographic Emulsion"*, The Focal Press, 1964, F. H. Claes et al, *"The Journal of Photographic Science"*, (21) 39–50, F. H. Claes et al., *"The Journal of Photographic Science"*, (21) 85–92, 1973, JP-B-55-42737, U.S. Pat. Nos. 4,400,463 and 4,801,523, JP-A-62-218959, JP-A-63-213836, JP-A-63-218938, and JP-A-2-32. In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, in which a pAg value of a liquid phase in which silver halide grains are formed is maintained constant, may also be used. According to the controlled double jet process, a silver halide emulsion having a regular crystal form and an almost uniform grain size can be obtained.

Further, an emulsion prepared by a so-called conversion method including a process by which silver halide grains already formed are converted before the completion of a process for the formation of silver halide grains or an emulsion prepared by the similar halogen conversion after the completion of a process for the formation of silver halide grains may be used as well.

During the preparation of silver halide grains of the present invention, a silver halide solvent may be used.

Examples of silver halide solvents which are often used in such a case include thioether compounds as disclosed in U.S. Pat. Nos. 3,271,157, 3,574,628, 3,704,130, and 4,276,347, thione compounds and thiourea compounds as disclosed in JP-A-53-144319, JP-A-53-82408, and JP-A-55-77737, and amine compounds as disclosed in JP-A-54-100717. These solvents can be used in the present invention. Further, ammonia can be used so far as it gives no adverse effects.

During the preparation of silver halide grains of the present invention, a method which involves the rise in the addition rate, added amount and added concentration of silver salt solution (e.g., aqueous solution of silver nitrate) and halide solution (e.g., aqueous solution of sodium chloride) with time is preferably used to expedite the growth of grains. For details of this method, reference can be made to British Patent 1,335,925, U.S. Pat. Nos. 3,672,900, 3,650,757, and 4,242,445, JP-A-55-142329, JP-A-55-158124, JP-A-55-113927, JP-A- 58-113928, JP-A-58-111934, and JP-A-58-111936.

During the formation or physical ripening of silver halide grains, a cadmium salt, zinc salt, lead salt, potassium salt, rhenium salt, ruthenium salt, iridium salt or complex salt thereof, rhodium salt or complex salt thereof, or iron salt or complex salt thereof may be present in the system. Preferred among these salts are rhenium salt, iridium salt, rhodium salt, and iron salt.

The amount of such a salt to be added may be arbitrary as necessary. For example, an iridium salt (e.g., $Na_3IrCl_6$, $Na_2IrCl_6$, $Na_3Ir(CN)_6$) may be used in an amount of $1\times10^{-8}$ mol to $1\times10^{-5}$ mol per mol of silver. A rhodium salt (e.g., $RhCl_3$, $K_3Rh(CN)_6$) may be used in an amount of $1\times10^{-8}$ mol to $1\times10^{-6}$ mol per mol of silver.

The silver halide emulsion of the present invention may not be chemically sensitized but may be chemically sensitized as necessary.

Examples of chemical sensitization method employable in the present invention include gold sensitization method with a so-called gold compound (as disclosed in U.S. Pat. Nos. 2,448,060 and 3,320,069), sensitization method with a metal such as iridium, platinum, rhodium and palladium (as disclosed in U.S. Pat. Nos. 2,448,060, 2,566,245, and 2,566,263), sulfur sensitization method with a sulfur-containing compound (as disclosed in U.S. Pat. No. 2,222,264), selenium sensitization method with a selenium compound, reduction sensitization method with a tin salt, thiourea dioxide, polyamide or the like (as disclosed in U.S. Pat. Nos. 2,487,850, 2,518,698, and 2,521,925), and combination thereof.

The silver halide emulsion of the present invention is preferably subjected to gold sensitization, sulfur sensitization, or combination thereof. The optimum amount of the gold sensitizer and sulfur sensitizer to be added each are in the range of $1\times10^{-7}$ to $1\times10^{-2}$ mol, preferably $5\times10^{-6}$ to $1\times10^{-3}$ mol per mol of silver. If gold sensitization and sulfur sensitization are used in combination, the optimum molar proportion of gold sensitizer to sulfur sensitizer is in the range of 1:3 to 3:1, preferably 1:2 to 2:1.

The temperature at which the chemical sensitization according to the present invention is effected can be selected from values between 30° C. and 90° C. The pH value at which the chemical sensitization is effected is in the range of 4.5 to 9.0, preferably 5.0 to 7.0. The chemical sensitization time varies with temperature, kind and amount of chemical sensitizer used, pH, etc. and thus cannot be unequivocally determined. It can be arbitrarily selected from values between several minutes and several hours. It is normally between 10 minutes and 200 minutes.

A sensitizing dye is often used in combination with a water-soluble iodide salt such as potassium iodide, water-soluble bromide salt such as potassium iodide or water-soluble thiocyanate salt such as potassium thiocyanate to accelerate its adsorption to silver halide grains or formation of J-aggregates for higher spectral sensitivity. In the present invention, these salts may be also preferably used. Such water-soluble bromide salt and water-soluble thiocyanate salt have a marked effect on silver chloride or silver bromochloride having a high silver chloride content.

In order to attain an ultrarapid processing requiring 30 seconds or less for development, a high silver chloride content emulsion having a silver chloride content of not less than 50 mol % is preferably used. As well known, iodine ion is highly development-inhibiting. For the foregoing purpose, the content of iodine ion, including the foregoing water-soluble iodide, is preferably kept at not more than 0.05 mol % per mol of silver.

In order to prepare a silver halide photographic material adapted for ultrarapid processing, a high silver chloride content emulsion having a silver chloride content of not less than 80 mol % is preferably used. As mentioned above, such an emulsion may be preferably used in combination with a water-soluble bromide salt and/or water-soluble thiocyanate salt to accelerate the formation of J-aggregates for higher spectral sensitivity. The amount of such a salt to be added is preferably in the range of 0.03 to 3 mol %, particularly 0.08 to 1 mol % per mol of silver.

As such a high silver chloride content emulsion having a silver chloride content of not less than 80 mol % there may be preferably used a high silver chloride content emulsion having a localized phase in grain which exhibits a high sensitivity and a high stability, particularly of latent image when spectrally sensitized in the infrared range as disclosed in JP-A-2-248945. As disclosed in the foregoing patent, such a localized phase preferably has a silver bromide content of more than 15 mol %, more preferably from 20 to 60 mol %, most preferably 30 to 50 mol % and a balance of silver chloride. Further, such a localized phase may be present inside or on the surface or subsurface of silver halide grain or may be divided into two portions by the surface or subsurface of grain. Moreover, such a localized phase may have a layer structure surrounding the silver halide grain or discontinuously independent structure. A specific preferred example of a localized phase having a higher silver bromide content than its surroundings is a localized phase having a silver bromide content of more than at least 15 mol % epitaxially grown locally on the surface of silver halide grain.

The silver bromide content of such a localized phase can be analyzed by X-ray diffractometry (as described in "Shinjikken Kagaku Koza 6 (New Institute of Experimental Chemistry 6)—Kozo Kaiseki (Structural Analysis)", Chemical Society of Japan, Maruzen), XPS method (as described in "Surface Analysis, IMA, Application of Auger Electron/Photoelectron Spectroscopy", Kodansha), etc. Such a localized phase preferably comprises silver in an amount of 0.1 to 20%, more preferably 0.5 to 7% of the total amount of silver constituting the silver halide grain.

The interface of such a localized phase having a high silver bromide content with other phases may be definite or may have a short transition region having a slow halogen composition gradient.

The formation of such a localized phase having a high silver bromide content can be accomplished by various methods. For example, a method can be used which comprises the reaction of a soluble silver salt and a soluble halogen salt in a single or double jet process to form a localized phase. Alternatively, a so-called conversion method can be used which comprises the conversion of silver halide already formed to one having a smaller solubility product to form a localized phase. Further, a localized phase can be formed by adding finely divided silver bromide grains to allow them to be recrystallized on the surface of silver halide grains.

The silver halide emulsion prepared according to the present invention can be applied to either color photographic light-sensitive materials or black-and-white photographic light-sensitive materials.

Examples of color photographic light-sensitive materials to which the silver halide emulsion according to the present invention can be applied include color paper, color film for picture taking, and color reversal film. Examples of black-and-white photographic light-sensitive materials to which the silver halide emulsion according to the present invention can be applied include X-ray film, common film for picture taking, and film for printing photographic material.

Additives which can be incorporated in the photographic light-sensitive material to which the emulsion according to the present invention is applied are not specifically limited. For details of these additives, reference can be made to Research Disclosure, vol. 176, Item 17643 (RD17643) and vol. 187, Item 18716 (RD18716).

The place at which various additives are described in RD17643 and RD18716 are tabulated below.

TABLE 1

| Kind of additive | RD17643 | RD18716 |
|---|---|---|
| 1. Chemical sensitizer | p. 23 | p. 648, right |

TABLE 1-continued

| Kind of additive | RD17643 | RD18716 |
|---|---|---|
| | | column (RC) |
| 2. Sensitivity increasing agent | | p. 648, right column (RC) |
| 3. Spectral sensitizer and supersensitizer | pp. 23–24 | p. 648, RC–p. 649, RC |
| 4. Brightening agent | p. 24 | |
| 5. Antifoggant and stabilizer | pp. 24–25 | p. 649, RC |
| 6. Light absorbent, filter dye, and ultraviolet absorbent | pp. 25–26 | p. 649, RC–p. 650, left column (LC) |
| 7. Stain inhibitor | p. 25, RC | p. 650, LC–RC |
| 8. Dye image stabilizer | p. 25 | |
| 9. Hardening agent | p. 26 | p. 651, LC |
| 10. Binder | p. 26 | p. 651, LC |
| 11. Plasticizer and lubricant | p. 27 | p. 650, RC |
| 12. Coating aid and surface active agent | pp. 26–27 | p. 650, RC |
| 13. Antistatic agent | p. 27 | p. 650, RC |

The dyes will be further described hereinafter.

The photographic light-sensitive material according to the present invention may comprise a colloidal silver or a dye to inhibit irradiation or halation, provide a predetermined separation of the spectral sensitivity distribution of various light-sensitive layers and secure stability to safe light.

Examples of such a dye include oxonol dyes having pyrazolone nucleus, barbituric nucleus or barbituric acid nucleus as disclosed in U.S. Pat. Nos. 506,385, 1,177,429, 1,131,884, 1,338,799, 1,385,371, 1,467,214, 1,438,102, 1,553,516, 3,247,127, 3,469,985, and 4,078,933, JP-A-48-85130, JP-A-49-114420,JP-A-52-117123,JP-A-55-161233, JP-A-59-111640, JP-B-39-22069, JP-B-43-13168, and JP-B-62-273527, other oxonol dyes as disclosed in U.S. Pat. Nos. 2,533,472, and 3,379,533, British Patent 1,278,621, JP-A-1-134447, and JP-A-1-183652, azo dyes as disclosed in British Pat. Nos. 575,691,680,631,599,623, 786,907, 907, 125, and 1,045,609, U.S. Pat. No. 4,255,326, and JP-A-59-211043, azomethine dyes as disclosed in JP-A-50-100116, JP-A-54-118247, British Pat. Nos. 2,014,598, and 750,031, anthraquinone dyes as disclosed in U.S. Pat. No. 2,865,752, arylidene dyes as disclosed in U.S. Pat. Nos. 2,538,009, 2,688,541, and 2,538,008, British Pat. Nos. 584,609, and 1,210,252, JP-A-50-40625, JP-A-51-3623, JP-A-51-10927, JP-A-54-118247, JP-B-48-3286, and JP-B-59-37303, styryl dyes as disclosed in JP-B-28-3082, JP-B-44-16594, and JP-B-59-28898, triarylmethane dyes as disclosed in British Pat. Nos. 446,538, and 1,335,422, and JP-A-59-228250, melocyanine dyes as disclosed in British Pat. Nos. 1,075, 653, 1,153,341, 1,284,730, 1,475,228, and 1,542,807, and cyanine dyes as disclosed in U.S. Pat. Nos. 2,843,486, and 3,294,539, and JP-A-1-291247.

In order to inhibit the diffusion of these dyes, the following methods can be used. For example, a ballast group may be incorporated in these dyes so that they can be rendered nondiffusive.

A method which comprises allowing a dissociated anionic dye and a hydrophilic polymer having electric charge opposite the anionic dye as a mordant to be present in a layer to effect interaction with dye molecules so that the dye is localized in a specified layer is disclosed in U.S. Pat. Nos. 2,548,564, 4,124,386, and 3,625,694, etc.

Further, a method which comprises dyeing a specified layer with a water-insoluble dye solid is disclosed in JP-A-56-12639, JP-A-55-155350, JP-A-55-155351, JP-A-63-27838, JP-A-63-197943, EP 15,601, etc.

A method which comprises dyeing a specified layer with finely divided metal salt grains which have adsorbed a dye is disclosed in U.S. Pat. Nos. 2,719,088, 2,496,841, and 2,496,843, JP-A-60-45237, etc.

Among the foregoing additives, as fog inhibitor and stabilizer there can be preferably used azoles such as benzothiazolium salt, nitroimidazole, nitrobenzimidazole, chlorobenzimidazole, bromobenzimidazole, nitroindazole, benzotriazole and aminotriazole, mercapto compounds such as mercaptothiazole, mercaptobenzothiazole, mercaptobenzimidazole, mercaptothiadiazole, mercaptotetrazole (particularly 1-phenyl-5-mercaptotetrazole), mercaptopyrimidine and mercaptotriazine, thioketo compounds such as oxazolinethione, azaindenes such as triazaindene, tetraazaindene (particularly 4-hydroxy-substituted (1,3,3a,7)tetraazaindene) and pentaazaindene, benzenethiosulfonic acid, benzenesulfinic acid, and amide benzenesulfonate.

As the color coupler there may be preferably used a nondiffusive color coupler having a hydrophobic group called ballast group in its molecule or polymerized color coupler. The color coupler may be either two-equivalent or four-equivalent of silver ion. Alternatively, a colored coupler having an effect of correcting color, or a coupler which releases a development inhibitor upon development (so-called DIR coupler) may be incorporated in the system. Further, a noncolor DIR coupling compound which undergoes coupling reaction to give a colorless product and release a development inhibitor may be incorporated in the system.

Preferred examples of these couplers are described in JP-A-2-33144, line 14, upper right column, page 3—last line, upper left column, page 18, and line 6, upper right column, page 30—line 11, lower right column, page 35.

In some detail, examples of magenta couplers include 5-pyrazolone coupler, pyrazolobenzimidazole coupler, pyrazolotriazole coupler, pyrazolotetrazole coupler, cyanoacetylcumaron coupler, and closed-chain acylacetonitrile coupler. Examples of yellow couplers include acrylacetamide coupler (e.g., benzoylacetanilide, pivaloylacetanilide). Examples of cyan couplers include naphthol coupler, and phenol coupler. As cyan couplers there can be preferably used phenolic coupler having an ethyl group in the meta-position of phenol nucleus, 2,5-diacylamino-substituted phenolic coupler, phenolic coupler having a phenylureide group in the 2-position and an acylamino group in the 5-position, and coupler substituted by sulfonamide, amide or the like in the 5-position on naphthol as disclosed in U.S. Pat. Nos. 3,772,002, 2,772,162, 3,758,308, 4,126,396, 4,334,011, 4,327,173, 3,446,622, 4,333,999, 4,451,559, and 4,427,767. These cyan couplers exhibit an excellent image fastness.

Two or more of these couplers may be incorporated in the same layer or the same compound may be incorporated in two or more layers to meet the requirements for photographic light-sensitive materials.

Typical examples of discoloration inhibitors include hydroquinones, 6-hydroxychromans, 5-hydroxycumarans, spirocumaran, p-alkoxyphenols, hindered phenols such as bisphenols, gallic acid derivatives, methylenedioxybenzenes, aminophenols, hindered amines, and ether or ester derivatives obtained by silylation or alkylation of phenolic hydroxyl group in these compounds. Further, metal complexes such as (bissalicylaldoximate)nickel complex and (bis-N,N-dialkyldithiocarbamate)nickel complex can be used as well.

The photographic processing of the photographic light-sensitive material according to the present invention can be accomplished by any known method with any known processing solution. The processing temperature may be normally selected from values between 18° C. and 50° C. but may fall below 18° C. or exceed 50° C. Development for the formation of silver image (black-and-white photographic processing) or color photographic processing comprising development for the formation of dye image can be applied depending on the purpose.

The black-and-white developer may comprise known developing agents such as dihydroxybenzenes (e.g., hydroquinone), 3-pyrazolidones (e.g., 1-phenyl-3-pyrazolidone) and aminophenols (e.g., N-methyl-p-aminophenol), singly or in combination.

A color developer normally comprises an alkaline aqueous solution containing a color developing agent. As such a color developing agent there can be used a known primary aromatic amine developing agent such as phenylenediamines (e.g., 4-amino-N,N-diethylaniline, 3-methyl-4-amino-N,N-diethylaniline, 4-amino-N-ethyl-N-β-hydroxyethylaniline, 3 -methyl-4-amino-N-ethyl-N-β-hydroxyethylaniline, 3-methyl-4 -amino-N-ethyl-N-β-methanesulfoamidoethylaniline, 4-amino-3-methyl-N-ethyl-N-β-methoxyethylaniline).

Further, developing agents as described in L. F. A. Meson, "*Photographic Processing Chemistry*", Focal Press, 1966, pp. 226–229, U.S. Pat. Nos. 2,193,015, and 2,592,364, and JP-A-48-64933 can be used.

The developer may further comprise a pH buffer such as sulfite, carbonate, borate and phosphate of alkaline metal, a development inhibitor such as bromide, iodide and organic fog inhibitor, a fog inhibitor or the like incorporated therein. If necessary, the developer may comprise a water softener, a preservative such as hydroxylamine, an organic solvent such as benzyl alcohol and diethylene glycol, a development inhibitor such as polyethylene glycol, quaternary ammonium salt and amine, a dye-forming coupler, a competing coupler, a fogging agent such as sodium boron hydride, an auxiliary developing agent such as 1-phenyl-3-pyrazolidone, a thickening agent, a polycarboxylic chelating agent as disclosed in U.S. Pat. No. 4,083,723, an oxidation inhibitor as disclosed in West German Patent Disclosure (OLS) 2,622,950, etc. incorporated therein.

In the color photographic processing, the photographic light-sensitive material which has been subjected to color development is normally subjected to bleach. Bleach may be effected at the same time with or separately of fixing. As the bleaching agent there may be used a compound of a polyvalent metal such as iron (III), cobalt (III), chromium (VI) and copper (II), peroxides, quinones, nitroso compound or the like. For example, ferricyanides, bichormates, organic complex salts of iron (III) or cobalt (III) with, e.g., organic acids such as aminopolycarboxylic acid (e.g., ethylenediaminetetraacetic acid, nitrilotriacetic acid, 1,3-diamino-2-propanoltetraacetic acid), citric acid, tartaric acid and malic acid, persulfates, permanganates, nitrosophenol, etc. blix bath may comprise a bleach accelerator as disclosed in U.S. Pat. Nos. 3,042,520, and 3,241,966, JP-B-45-8506, and JP-B-45-8836, a thiol compound as disclosed in JP-A-53-65732, and various additives incorporated therein. Further, the photographic light-sensitive material which has been subjected to bleach or blix may be then subjected to rinsing or may be merely subjected to processing in a stabilizing bath.

As the support employable in the present invention there can be used a transparent film commonly used in photographic light-sensitive materials such as cellulose nitrate film and polyethylene terephthalate film or reflective support.

The term "reflective support" as used herein means a support which enhances the reflectivity of a photographic light-sensitive material to make a dye image formed in the silver halide emulsion layer clear. Examples of such a reflective support include a support which has been coated with a hydrophobic resin having a light-reflecting substance such as titanium oxide, zinc oxide, calcium carbonate and calcium sulfate dispersed therein to enhance the reflectivity thereof in the visible light range or a hydrophobic resin having a light-reflecting substance incorporated therein. Specific examples of such a reflective support include baryta paper, polyethylene-coated paper, polypropylenic synthetic paper, and transparent support (e.g., glass plate, polyethylene terephthalate, polyester film such as cellulose triacetate and cellulose nitrate, polycarbonate film, polystyrene film, vinyl chloride resin) laminated with a reflective layer or comprising a reflective substance incorporated therein. These supports can be properly selected depending on the purpose.

Exposure for obtaining a photographic image may be effected by an ordinary method. In some detail, any of various known light sources such as natural light (sunshine), tungsten lamp, fluorescent lamp, mercury vapor lamp, xenon arc lamp, carbon arc lamp, xenon flash light, laser, LED and CRT may be used. The exposure time can be shorter than 1/1,000 seconds, e.g., $1/10^4$ to $1/10^6$ seconds with a xenon flash light, or longer than 1 second, not to mention 1/1,000 seconds to 1 second commonly used for camera. As necessary, the spectral composition of exposing light can be adjusted by a color filter. Laser beam can be used for exposure. Further, light rays emitted by a fluorescent substance excited by electron ray, X-ray, γ-ray, α-ray or the like may be used for exposure.

The present invention will be further described in the following examples, but the present invention should not be construed as being limited thereto.

EXAMPLE 1

Synthesis of Compound (II-9)

The synthesis of Compound (II-9) was effected in accordance with Scheme 1:

Scheme 1

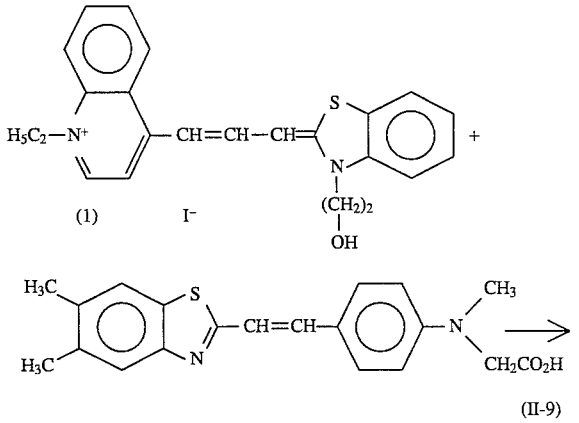

(2)

2 g (0.004 mol) of a starting material (1), 2.1 g (0.006 mol) of a starting material (2), 0.2 g (0.0012 mol) of p-toluenesulfonic monohydrate, 7.4 g (0.036 mol) of DCC (dicyclohexyl carbodiimide) and 80 ml of pyridine were stirred at an external temperature of 60° C. for 90 minutes. The reaction solvent was distilled off under reduced pressure. The residue was purified by silica gel column chromatography (developing solvent: 1:4 mixture of methanol and chloroform), and then recrystallized from methanol to obtain 0.25 g of Compound (II-9) (yield: 7.5%; melting point: 186°–190° C.; $\lambda_{max}$: 628 nm; $\epsilon$: $1.20\times10^5$ (methanol)).

EXAMPLE 2

Synthesis of Compound (II-10)

Compound (II-10) was prepared in the same manner as in Example 1 except that the compound represented by formula (3) was used instead of the starting material (1). (Yield: 17%; melting point: 176°–182° C.; $\lambda_{max}$: 632 nm; $\epsilon$: $1.17\times10^5$ (methanol)).

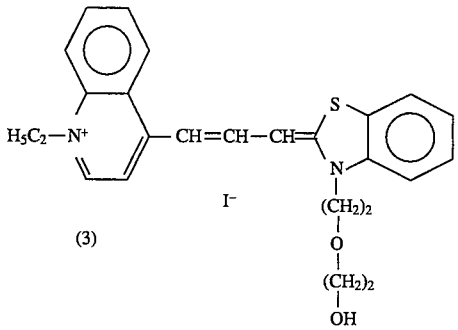

(3)

EXAMPLE 3

Synthesis of Compound (V-1)

The synthesis of Compound (V-1) was effected in accordance with Scheme 2:

Scheme 2

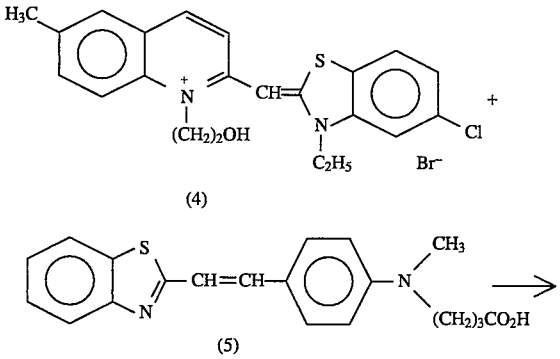

(4)

(5)

(V-1)

1.5 g (0.003 mol) of a starting material (4), 1.7 g (0.005 mol) of a starting material (5), 0.2 g (0.001 mol) of p-toluenesulfonic monohydrate, 5.8 g (0.03 mol) of DCC (dicyclohexylcarbodiimide), and 40 ml of pyridine were heated under reflux for 30 minutes. The reaction solvent was then distilled off under reduced pressure. The residue was then purified by a silica gel column chromatography (developing solvent: 1:4 mixture of methanol and methylene chloride). 0.6 g of sodium iodide was added to the material. The material was then concentrated and recrystallized from a mixture of methanol and chloroform to obtain 0.7 g of Compound (V-1) (Yield: 25%; melting point: 148°–154° C.; $\lambda_{max}$: 494 nm; $\epsilon$: $4.71\times10^4$ (methanol))

EXAMPLE 4

Synthesis of Compound (V-2)

Compound (V-2) was prepared in the same manner as in Example 3 except that the compound represented by formula (6) was used instead of the starting material (3). (Yield: 33%; melting point: 156°–162° C.; $\lambda_{max}$: 492 nm; $\epsilon$: $4.53\times10^4$ (methanol)).

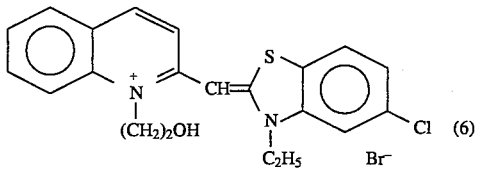

(6)

EXAMPLE 5

Synthesis of Compound (VI-1)

The synthesis of Compound (VI-1) was effected in accordance with Scheme 3:

Scheme 3

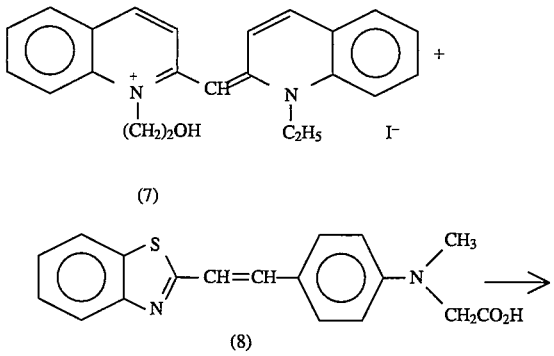

(7)

(8)

(VI-1)

2 g (0.0043 mol) of a starting material (7), 2.1 g (0.0064 mol) of a starting material (8), 0.24 g (0.0013 mol) of p-toluenesulfonic monohydrate, 7.9 g (0.038 mol) of DCC, and 50 ml of pyridine were heated under reflux for 30 minutes. The reaction solvent was then distilled off under reduced pressure. The residue was then purified by a silica gel column chromatography (developing solvent: 1:4 mixture of methanol and chloroform). The solvent was then distilled off under reduced pressure (about 10 ml remained). To the residue was added ethyl acetate to effect crystallization. The resulting crystal was then recovered by suction filtration to obtain 1.1 g of Compound (VI-1). (Yield: 31%; melting point: 149°–153° C.; $\lambda_{max}$: 527 nm; $\epsilon$: $6.3\times10^4$ (methanol))

EXAMPLE 6

Synthesis of Compounds (VI-2), (VI-3)

Compound (VI-2) was prepared in the same manner as in Example 5 except that the compound represented by formula (9) was used instead of the starting material (8). (Yield: 53%; melting point: 134°–137° C.; $\lambda_{max}$: 528 nm; ε: 6.42×$10^4$ (methanol)).

Compound (VI-3) was prepared in the same manner as in Example 5 except that the compound represented by formula (10) was used instead of the starting material (8). (Yield: 41%; melting point: 125°–129° C.; $\lambda_{max}$: 528 nm; ε: 6.3×$10^4$ (methanol)).

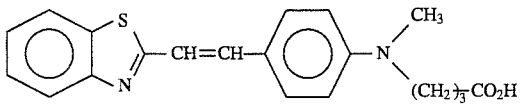

(9)

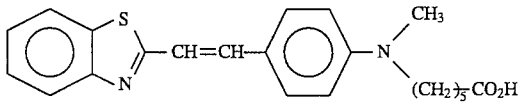

(10)

EXAMPLE 7

Into a reaction vessel were charged 1,000 ml of water, g of deionized bone gelatin, 15 ml of a 50% aqueous solution of $NH_4NO_3$ and 7.5 ml of a 25% aqueous solution of $NH_3$. The mixture was then vigorously stirred at a temperature of 50° C. To the emulsion were then added 750 ml of a 1N aqueous solution of silver nitrate and a 1N aqueous solution of potassium bromide in 50 minutes to keep the silver potential during the reaction at +60 mV with respect to a saturated calomel electrode.

The emulsion thus obtained comprised cubic silver bromide grains having a side length of 0.76±0.06 μm. The temperature of the emulsion was lowered. To the emulsion was then added a copolymer of isobutene and monosodium malate as a flocculating agent. The resulting precipitate was then washed with water to effect desalting. To the emulsion were then added 95 g of deionized bone gelatin and 430 ml of water so that the pH and pAg values thereof were adjusted to 6.5 and 8.3, respectively. Subsequently, to the emulsion was added sodium thiosulfate at a temperature of 40° C. The emulsion was then ripened at a temperature of 55° C. for 45 minutes to obtain an optimum sensitivity. The emulsion comprised silver bromide in an amount of 0.74 mol per kg.

To 50 g of the emulsion were then added sensitizing dyes as set forth in Table 2 at a temperature of 35° C., respectively. These emulsions were each ripened at a temperature of 55° C. for 30 minutes. The temperature of the emulsions were each lowered to 40° C. To the emulsions were then added the compound represented by formula (I) of the present invention and comparative compounds as set forth in Table 2, respectively. To these emulsions were each added 10 mg of 4-hydroxy-6-methyl-1,3,3a,7-tetrazaindene, 15 g of a 10% gel of deionized gelatin and 55 ml of water. These emulsions were each coated on a cellulose triacetate film base in the following manner.

The coated amount of these emulsions were each adjusted such that the coated amount of silver and gelatin reached 2.5 g/$m^2$ and 3.8 g/$m^2$, respectively. Onto the emulsion layer was simultaneously coated an aqueous solution containing 0.22 g/l of sodium dodecylbenzenesulfonate, 0.50 g/l of sodium p-sulfostyrene homopolymer, 3.9 g/l of 1,3-bis(vinylsulfonyl)-2 -propanol and 50 g/l of gelatin as main components.

The coating specimens thus prepared were each exposed to light from a tungsten lamp (2,856° K.) through an orange-colored film SC48 (capable of transmitting light at a wavelength range longer than 480 nm) available from Fuji Photo Film Co., Ltd. and a continuous wedge for 1 second. These specimens thus exposed were each developed with a developer prepared by diluting D-72 developer by a factor of 3 and then adjusting the pH value thereof to 10.4, stopped, fixed, rinsed, and then dried. These specimens were each measured for density by means of a densitometer available from Fuji Photo Film Co., Ltd. to determine sensitivity with orange-color filter ($S_0$) and fog. The criteria of optical density on which sensitivity is determined was "fog plus 0.2". The sensitivity was represented by the reciprocal of the exposure required for the optical density. The results are shown relative to a reference in Table 2. In some detail, the results are shown relative to the orange filter sensitivity of the first specimen in each group as 100.

Further, these specimens were each allowed to stand at a temperature of 50° C. and a relative humidity of 80% for 3 days. These specimens were each subjected to exposure and development in the same manner as above. The sensitivity of these specimens are shown relative to that of the unaged specimens as 100.

TABLE 2

| Specimen No. | Sensitizing dye and added amount ($10^{-4}$ mol/mol Ag) | | Additive compound and added amount ($10^{-4}$ mol/mol Ag) | | Relative sensitivity ($S_0$) | Fog | Sensitivity change with time ($\Delta S_0$) | Remarks |
|---|---|---|---|---|---|---|---|---|
| 2-1 | S-1 | 8.0 | — | | 100 (reference) | 0.04 | 71 | Comparative |
| 2-2 | " | " | SS-1 | 0.8 | 204 | 0.05 | 55 | " |
| 2-3 | " | 7.2 | VI-1 | " | 245 | 0.04 | 91 | The invention |
| 2-4 | " | " | VI-2 | " | 251 | 0.04 | 91 | " |
| 2-5 | " | " | VI-3 | " | 245 | 0.04 | 89 | " |
| 2-6 | S-2 | 8.0 | — | | 100 (reference) | 0.04 | 71 | Comparative |
| 2-7 | " | " | SS-1 | 0.8 | 209 | 0.04 | 56 | " |
| 2-8 | " | " | SS-2 | " | 209 | 0.04 | 58 | " |
| 2-9 | " | 7.2 | V-1 | " | 257 | 0.04 | 93 | The invention |
| 2-10 | " | " | V-13 | " | 263 | 0.04 | 96 | " |
| 2-11 | S-3 | 8.0 | — | | 100 (reference) | 0.05 | 74 | Comparative |
| 2-12 | " | " | SS-1 | 0.8 | 120 | 0.06 | 63 | " |
| 2-13 | " | 7.2 | II-9 | " | 141 | 0.05 | 91 | The invention |
| 2-14 | " | " | II-10 | " | 145 | 0.05 | 93 | " |

TABLE 2-continued

| Specimen No. | Sensitizing dye and added amount ($10^{-4}$ mol/mol Ag) | Additive compound and added amount ($10^{-4}$ mol/mol Ag) | Relative sensitivity ($S_0$) | Fog | Sensitivity change with time ($\Delta S_0$) | Remarks |
|---|---|---|---|---|---|---|

S-1

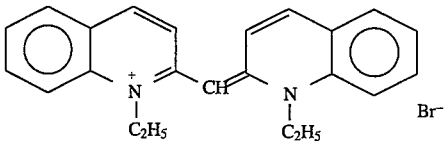

S-2

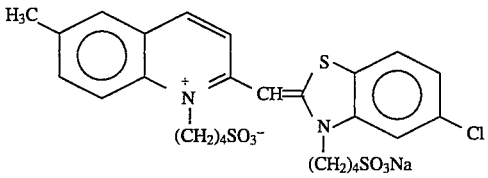

S-3

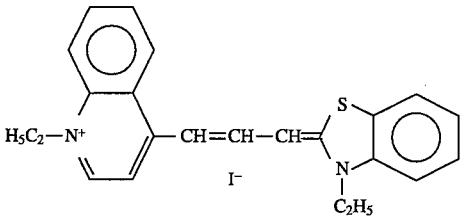

SS-1

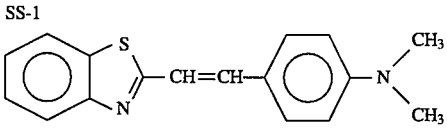

SS-2

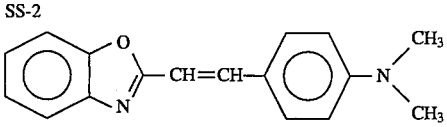

Table 2 shows that the specimens further comprising the comparative compounds (SS-1) and (SS-2) besides the sensitizing dyes exhibit a higher spectral sensitivity $S_0$ but a lower storage stability than the specimens free of these comparative compounds. On the other hand, it can also be seen that the specimens comprising the compounds of the present invention exhibit a higher spectral sensitivity $S_0$ and an enhanced storage stability.

EXAMPLE 8

The silver halide emulsion used in Example 8 was prepared in the following manner:

| | |
|---|---|
| (Solution 1) | |
| Water | 1,000 cc |
| NaCl | 4.65 g |
| Gelatin | 22 g |
| Citric acid | 0.80 g |
| (Solution 2) | |
| KBr | 25.3 g |
| NaCl | 32.3 g |
| $K_2IrCl_6$ (0.005%) | 11.2 cc |

-continued

| | |
|---|---|
| $Na_3RhCl_6.2H_2O$ ($10^{-5}$ mol/l) | 18.9 cc |
| Water to make | 348 cc |
| (Solution 3) | |
| $AgNO_3$ | 120.6 g |
| Water to make | 348 cc |
| (Solution 4) | |
| KBr | 30.0 g |
| NaCl | 48.7 g |
| Water to make | 552 cc |
| (Solution 5) | |
| $AgNO_3$ | 176.3 g |
| Water to make | 552 cc |

To Solution 1 were simultaneously added 262 cc of Solution 2 and 262 cc of Solution 3 at a constant flow rate while Solution 1 was heated to a temperature of 50° C. in 12 minutes. Thereafter, Solution 4 and Solution 5 were simultaneously added to the emulsion in 20 minutes. The temperature of the emulsion was then lowered. To the emulsion was then added a copolymer of isobutene and monosodium malate as a flocculating agent. The resulting precipitate was washed with water to effect desalting. To the emulsion were then added water and deionized bone gelatin so that the pH and pAg values thereof were adjusted to 6.1 and 7.5, respectively. As a result, a monodisperse emulsion of cubic silver bromochloride grains having an average side length of 0.28 μm, a grain size variation coefficient of 0.08 (as determined by dividing the standard deviation of grain size by the average side length: s/d) and a silver bromide content of 30 mol % was obtained.

To the emulsion were then added sodium thiosulfate, chloroauric acid and potassium thiocyanate. The emulsion was then ripened at a temperature of 55° C. so that it was chemically sensitized for optimum sensitivity. The emulsion was then divided into several groups. To these groups were then added sensitizing dyes as shown in Table 3, respectively, at a temperature of 50° C. After 20 minutes, to these groups were added the compound represented by formula (I) of the present invention or comparative compounds, respectively, and 4 -hydroxy-5,6-propanol-1,3,3a,7-tetrazaindene in an amount of $7.5\times10^{-4}$ per mol of silver bromochloride as shown in Table 3.

These emulsions were then each mixed with a 10% gel of deionized gelatin and water in an amount of 280 g and 1.04 l per kg of emulsion, respectively. To these emulsions were then each added 1,2-bis(vinylsulfonylacetylamino)ethane in an amount of 7 g per kg of emulsion. Onto a polyethylene terephthalate film base were each coated these emulsions in such an amount that the coated amount of silver reached 1.2 g/m$^2$ in the same manner as in Example 7.

These specimens were each subjected to exposure, development and measurement for density in the same manner as in Example 1 except that development was effected with a developer LD-835 available from Fuji Photo Film Co., Ltd. at a temperature of 38° C. for 20 seconds. Thus, the relative sensitivity and fog of these specimens were determined. The results are set forth in Table 3. The criteria of optical density on which sensitivity is determined was "fog plus 0.5". The orange-colored filter sensitivity ($S_0$) shown in Table 3 are represented relative to that of the first specimen in the respective group comprising the same spectral sensitizing dye as 100 as in Example 7.

Further, the sensitivity change of these specimens after ageing at 60° C.–70% RH for 2 days are set forth in Table 3. In some detail, these specimens were allowed to stand under the foregoing forced conditions, exposed to light, and then developed in the same manner as above to determine the orange-colored filter sensitivity thereof. The results are represented relative to that of the corresponding unaged specimens as 100.

TABLE 3

| Specimen No. | Sensitizing dye and added amount ($10^{-4}$ mol/mol Ag) | | Additive compound and added amount ($10^{-4}$ mol/mol Ag) | | Relative sensitivity ($S_0$) | Fog | Sensitivity change with time ($\Delta S_0$) | Remarks |
|---|---|---|---|---|---|---|---|---|
| 3-1 | S-4 | 6.0 | — | | 100 (reference) | 0.04 | 78 | Comparative |
| 3-2 | " | " | SS-1 | 0.6 | 407 | 0.04 | 62 | " |
| 3-3 | " | 5.4 | VI-1 | " | 447 | 0.04 | 89 | The invention |
| 3-4 | " | " | VI-2 | " | 457 | 0.04 | 87 | " |
| 3-5 | " | " | VI-3 | " | 468 | 0.04 | 91 | " |
| 3-6 | S-5 | 7.0 | — | | 100 (reference) | 0.04 | 78 | Comparative |
| 3-7 | " | " | SS-1 | 0.3 | 417 | 0.05 | 60 | " |
| 3-8 | " | " | SS-2 | " | 427 | 0.04 | 62 | " |
| 3-9 | " | 6.7 | V-1 | " | 457 | 0.04 | 91 | The invention |
| 3-10 | " | " | V-3 | " | 468 | 0.04 | 93 | " |
| 3-11 | S-3 | 8.0 | V-16 | " | 479 | 0.04 | 91 | " |

S-4

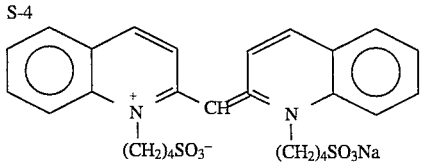

S-5

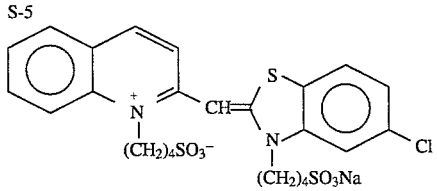

Table 3 shows that the specimens further comprising the comparative compounds (SS-1) and (SS-2) besides the sensitizing dyes exhibit a higher spectral sensitivity $S_0$ but a lower storage stability than the specimens free of these comparative compounds. On the other hand, it can also be seen that the specimens comprising the compounds of the present invention exhibit a higher spectral sensitivity $S_0$ and an enhanced storage stability.

EXAMPLE 9

6.5 g of potassium bromide, 1.2 g of potassium iodide and 4.9 g of potassium thiocyanate were added to 1 l of a 2% aqueous solution of gelatin. To the mixture were then added 0.4 l of an aqueous solution containing 57.5 g of potassium bromide and 2.5 g of potassium iodide and 0.4 l of an aqueous solution containing 85 g of silver nitrate at the same flow rate with stirring at a temperature of 70° C. by the double jet process in 45 minutes. To the emulsion was then added a copolymer of isobutene and monosodium malate at a temperature of 35° C. so that the pH value thereof was 3.8. The resulting precipitate was then washed with water. To the emulsion were then added gelatin, water and phenol so that the pH and pAg value thereof were adjusted to 6.8 and 8.7, respectively. The silver halide grains thus obtained exhibited an average diameter of 1.74 μm and an average thickness of 0.23 μm (average diameter/thickness: 7.57). The emulsion thus obtained was then divided into several groups. To these groups were each added sensitizing dyes as set forth in Table 4, respectively. These groups were each ripened with stirring for 15 minutes. To these groups were each added sodium thiosulfate hexahydrate, potassium tetraaurate and potassium thiocyanate. These emulsions were each rapidly heated to a temperature of 60° C. where they were ripened for optimum sensitivity.

These coating specimens were each subjected to exposure, development and measurement for density in the same manner as in Example 7. The results of sensitivity and fog are set forth in Table 4. The orange-colored filter sensitivity ($S_0$) shown in Table 4 are represented relative to that of the first specimen in the respective group comprising the same spectral sensitizing dye as 100 as in Example 7. The criteria of optical density on which sensitivity is determined was "fog plus 0.2".

Further, the storage stability of the specimens which had been exposed to light through an orange-colored filter are set forth in Table 4. In some detail, these specimens were allowed to stand at a temperature of 50° C. and a relative humidity of 80% for 5 days, exposed to light, and then developed in the same manner as above to determine the orange-colored filter sensitivity thereof. The results are represented relative to that of the corresponding unaged specimens as 100 ($\Delta R_0$).

TABLE 4

| Specimen No. | Sensitizing dye and added amount ($10^{-4}$ mol/mol Ag) | | Additive compound and added amount ($10^{-4}$ mol/mol Ag) | | Relative sensitivity ($S_0$) | Fog | Sensitivity change with time ($\Delta S_0$) | Remarks |
|---|---|---|---|---|---|---|---|---|
| 4-1 | S-6 | 7.0 | — | | 100 (reference) | 0.05 | 72 | Comparative |
| 4-2 | " | " | SS-1 | 0.7 | 120 | 0.05 | 56 | " |
| 4-3 | " | 6.3 | III-5 | " | 132 | 0.05 | 87 | The invention |
| 4-4 | S-7 | 7.0 | — | | 100 (reference) | 0.04 | 71 | Comparative |
| 4-5 | " | " | SS-1 | 0.7 | 117 | 0.04 | 55 | " |
| 4-6 | " | 6.3 | IV-7 | " | 132 | 0.04 | 85 | The invention |
| 4-7 | S-1 | 7.0 | — | | 100 (reference) | 0.04 | 81 | Comparative |
| 4-8 | " | " | SS-1 | 0.7 | 427 | 0.04 | 66 | " |
| 4-9 | " | 6.3 | IV-1 | " | 479 | 0.04 | 93 | The invention |
| 4-10 | S-5 | 7.0 | — | | 100 (reference) | 0.04 | 83 | Comparative |
| 4-11 | " | " | SS-1 | 0.7 | 437 | 0.05 | 69 | " |
| 4-12 | " | " | SS-2 | " | 437 | 0.04 | 68 | " |
| 4-13 | " | 6.3 | V-2 | " | 490 | 0.04 | 91 | The invention |
| 4-14 | " | " | V-3 | " | 501 | 0.04 | 93 | " |
| 4-15 | " | " | V-16 | " | 513 | 0.04 | 91 | " |

S-6

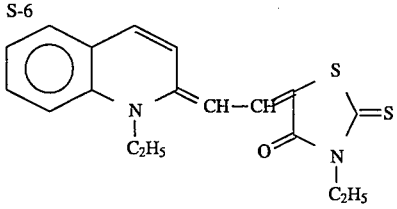

S-7

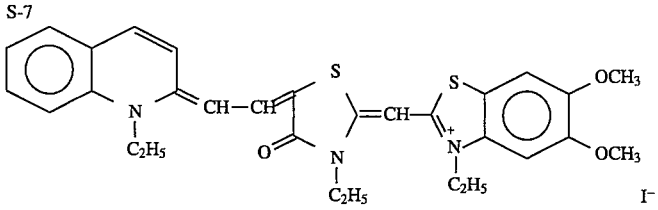

To these silver bromoiodide emulsions thus prepared were then each added the compound (I) of the present invention as shown in Table 4 at a temperature of 40° C. To these emulsions were then each added a 14% gel of deionized gelatin, water and 4-hydroxy-6-methyl-1,3,3a,7-tetrazaindene in an amount of $2\times10^{-3}$ mol per mol of silver bromoiodide. The mixtures were each stirred. Onto an antistatically treated polyethylene terephthalate film base were coated these emulsions, respectively, in the same manner as in Example 7.

Table 4 shows that the specimens further comprising the comparative compounds (SS-1) and (SS-2) besides the sensitizing dyes exhibit a higher spectral sensitivity $S_0$ but a lower storage stability than the specimens free of these comparative compounds. On the other hand, it can also be seen that the specimens comprising the compounds of the present invention exhibit a higher spectral sensitivity $S_0$ and an enhanced storage stability.

EXAMPLE 10

Emulsion I comprising tabular silver bromoiodide grains having a triple structure was prepared by the controlled double jet process. Emulsion I exhibited a grain diameter of 0.69 μm in sphere equivalence and a grain size variation coefficient of 20%. The grains having a diameter/thickness ratio of not less than 2 exhibited an average diameter/thickness ratio of 6.2. Emulsion I had a total silver iodide content of 4.1 mol %. In Emulsion I, a dislocation line was observed in the vicinity of the periphery of tabular grains in accordance with the method using a transmission electron microscope as described in JP-A-3-237450. The emulsion was then divided into three parts. These parts were then each subjected to gold sensitization, sulfur sensitization and selenium sensitization in the presence of sensitizing dyes as set forth in Table 5, respectively, and sodium thiocyanate to prepare Emulsions I-1 to I-3 in accordance with the working examples of JP-A-3-237450.

Onto a triacetyl cellulose support were each coated Emulsions I-1 to I-3 in the same manner as the process for the preparation of coating specimen as described in Example 1 of JP-A-5-241284 except that Emulsion A, Emulsion a and the sensitizing dye to be incorporated in the emulsion layer were replaced by Emulsions I-1 to I-3, respectively, in such an amount that the coated amount of silver in these emulsions were the same.

The sensitivity of these emulsions were represented by the relative value of the reciprocal of the exposure required to obtain an optical density of fog plus 0.2. Comparison of photographic sensitivity was made between the specimen which had been exposed to light immediately after preparation and the specimen which had been stored at a temperature of 50° C. and a relative humidity of 80% for 3 days.

Table 5 shows that the specimens comprising a supersensitizer SS-1 in conjunction with a quinoline dye exhibit a remarkably enhanced sensitivity. Further, the specimens comprising Compound (V-1) of the present invention having a quinoline dye and a supersensitizer connected to each other instead of SS-1 can provide an emulsion having a higher sensitivity. The use of the supersensitizer SS-1 is disadvantageous in that it is liable to a remarkable sensitivity drop after storage at a temperature of 50° C. and a relative humidity of 80%. It can also be seen that the use of Compound (V-1) of the present invention can eliminate the foregoing disadvantage.

TABLE 5

| Emulsion No. | Sensitizing dye (added amount: mol/mol Ag) | Supersensitizer (added amount: mol/mol Ag) | Photographic sensitivity before storage* | Photographic sensitivity after storage* |
|---|---|---|---|---|
| I-1 (comparative) | S-8 ($5.2 \times 10^{-4}$) S-2 ($5.2 \times 10^{-4}$) | None | 100 | 97 |
| I-2 (comparative) | S-8 ($5.2 \times 10^{-4}$) S-2 ($5.2 \times 10^{-4}$) | SS-1 ($3.0 \times 10^{-5}$) | 145 | 120 |
| I-3 (the invention) | S-8 ($5.2 \times 10^{-4}$) S-2 ($4.9 \times 10^{-4}$) | (V-1) ($3.0 \times 10^{-5}$) | 163 | 158 |

*Before storage: immediately after preparation of coating specimen

TABLE 5-continued

After storage: after storage at 50° C. −80% RH for 3 days following preparation of coating specimen

S-8

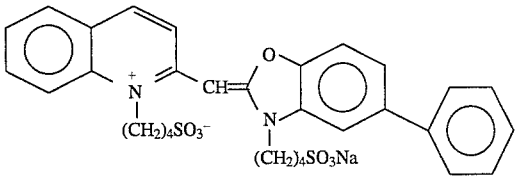

EXAMPLE 11

A multi-layer color light-sensitive material was prepared as Specimen 101 by coating on an undercoated cellulose triacetate film support various layers having the following compositions:

(Composition of light-sensitive layer)

The coated amount of silver halide and colloidal silver is represented in g/m$^2$ as calculated in terms of silver. The coated amount of coupler, additive and gelatin is represented in g/m$^2$. The coated amount of sensitizing dye is represented in the number of moles per mole of silver halide in the same layer. The symbols indicating additives represent the following meanings. Additives having a plurality of effects are represented by typical one of the effects.

UV: ultraviolet absorbent; Solv: high boiling organic solvent; ExF: dye; ExS: sensitizing dye; ExC: cyan coupler; ExM: magenta coupler; ExY: yellow coupler; Cpd: additive

| | |
|---|---|
| 1st layer: antihalation layer | |
| Black colloidal silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-5 | $1.0 \times 10^{-3}$ |
| Solv-1 | 0.16 |
| Solv-2 | 0.10 |
| 2nd layer: low sensitivity red-sensitive emulsion layer | |
| Silver bromoiodide emulsion A | 0.35 (in silver equivalence) |
| Silver bromoiodide emulsion B | 0.18 (in silver equivalence) |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $5.0 \times 10^{-3}$ |
| ExC-3 | $4.0 \times 10^{-2}$ |
| ExC-5 | $8.0 \times 10^{-2}$ |
| ExC-6 | $2.0 \times 10^{-2}$ |
| ExC-9 | $2.5 \times 10^{-2}$ |
| Cpd-4 | $2.2 \times 10^{-2}$ |
| 3rd layer: | |

-continued

| | |
|---|---|
| middle sensitivity red-sensitive emulsion layer | |
| Silver bromoiodide emulsion C | 0.35 (in silver equivalence) |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
| ExC-9 | $3.0 \times 10^{-2}$ |
| Cpd-4 | $1.5 \times 10^{-2}$ |
| 4th layer: high sensitivity red-sensitive emulsion layer | |
| Silver bromoiodide emulsion D | 1.05 (in silver equivalence) |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Solv-1 | 0.70 |
| Solv-2 | 0.15 |
| 5th layer: interlayer | |
| Gelatin | 0.62 |
| Cpd-1 | 0.13 |
| Polyethyl acrylate latex | $8.0 \times 10^{-2}$ |
| Solv-1 | $8.0 \times 10^{-2}$ |
| 6th layer: low sensitivity green-sensitive emulsion layer | |
| Silver bromoiodide emulsion E | 0.10 (in silver equivalence) |
| Silver bromoiodide emulsion F | 0.28 (in silver equivalence) |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.12 |
| ExM-7 | $2.1 \times 10^{-2}$ |
| Solv-1 | 0.09 |
| Solv-3 | $7.0 \times 10^{-3}$ |
| 7th layer: middle sensitivity green-sensitive emulsion layer | |
| Silver bromoiodide emulsion G | 0.37 (in silver equivalence) |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| 8th layer: high sensitivity green-sensitive emulsion layer | |
| Silver bromoiodide emulsion H | 0.53 (in silver equivalence) |
| Gelatin | 0.61 |
| ExS-4 | $4.3 \times 10^{-4}$ |

-continued

| | |
|---|---|
| ExS-5 | $8.6 \times 10^{-5}$ |
| ExS-8 | $2.8 \times 10^{-5}$ |
| ExM-2 | $5.5 \times 10^{-2}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| 9th layer: interlayer | |
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Polyethyl acrylate latex | $5.0 \times 10^{-2}$ |
| Solv-1 | $3.0 \times 10^{-2}$ |
| 10th layer: donor layer having an interlayer effect on red sensitive layer | |
| Silver bromoiodide emulsion I-1 | 0.99 (in silver equivalence) |
| Gelatin | 0.87 |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |
| 11th layer: yellow filter layer | |
| Yellow colloidal silver | $9.0 \times 10^{-2}$ |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| 12th layer: low sensitivity blue-sensitive emulsion layer | |
| Silver bromoiodide emulsion I | 0.50 (in silver equivalence) |
| Silver bromoiodide emulsion K | 0.40 (in silver equivalence) |
| Gelatin | 1.75 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |
| ExC-2 | $8.0 \times 10^{-2}$ |
| Solv-1 | 0.54 |
| 13th layer: interlayer | |
| Gelatin | 0.30 |
| ExY-4 | 0.14 |
| Solv-1 | 0.14 |
| 14th layer: high sensitivity blue-sensitive emulsion layer | |
| Silver bromoiodide emulsion L | 0.40 (in silver equivalence) |
| Gelatin | 0.95 |
| ExS-6 | $2.6 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| 15th layer: 1st protective layer | |
| Fine particle silver bromoiodide emulsion M | 0.12 (in silver equivalence) |
| Gelatin | 0.63 |

-continued

| | |
|---|---|
| UV-4 | 0.11 |
| UV-5 | 0.18 |
| Cpd-3 | 0.10 |
| Solv-4 | $2.0 \times 10^{-2}$ |
| Polyethyl acrylate latex | $9.0 \times 10^{-2}$ |
| 16th layer: 2nd protective layer | |
| Fine particle silver bromoiodide emulsion N | 0.36 (in silver equivalence) |
| Gelatin | 0.85 |
| B-1 (diameter: 2.0 μm) | $8.0 \times 10^{-2}$ |
| B-2 (diameter: 2.0 μm) | $8.0 \times 10^{-2}$ |
| B-3 | $2.0 \times 10^{-2}$ |
| W-5 | $2.0 \times 10^{-2}$ |
| H-1 | 0.18 |

Besides the above mentioned components, these specimens comprised 1,2-benzisothiazoline-3-one (200 ppm based on gelatin on the average), n-butyl-p-hydroxybenoate (about 1,000 ppm based on gelatin on the average) and 2-phenoxyethanol (about 10,000 ppm based on gelatin on the average). Further, W-1 to W-6, B-1 to B-6, F-1 to F-16, iron salt, lead salt, gold salt, platinum salt, iridium salt, and rhodium salt were properly incorporated in the various layers to improve the preservability, processability, pressure resistance, antifungal and antibacterial properties and antistatic properties thereof.

TABLE 6

| Emulsion | Average AgI content (mol %) | Average grain diameter in sphere equivalence (μm) | Grain diameter variation coefficient (%) | Diameter/thickness ratio | Silver content ratio [core/middle/shell] (AgI content) | Grain structure and shape |
|---|---|---|---|---|---|---|
| A | 4.7 | 0.40 | 10 | 1.0 | [4/1/5] (1/38/1) | Triple, cubic |
| B | 6.0 | 0.49 | 23 | 2.0 | [1/2] (16/1) | Double, tabular |
| C | 8.4 | 0.65 | 23 | 2.2 | [3/5/2] (0/14/7) | Triple, tabular |
| D | 8.8 | 0.65 | 15 | 3.5 | [12/59/29] (0/12/6) | Triple, flat, tabular |
| E | 4.0 | 0.35 | 25 | 2.8 | — | Homogeneous, tabular |
| F | 4.0 | 0.50 | 18 | 4.0 | — | Homogeneous, flat, tabular |
| G | 3.5 | 0.55 | 15 | 3.5 | [12/59/29] (0/5/2) | Triple, flat, tabular |
| H | 10.0 | 0.70 | 20 | 5.5 | [12/59129] (0/13/8) | Triple, flat, tabular |
| J | 9.0 | 0.66 | 19 | 5.8 | [8/59/33] (0/11/8) | Triple, flat, tabular |
| K | 2.5 | 0.46 | 30 | 7.0 | — | Homogeneous, flat, tabular |
| L | 13.9 | 1.30 | 25 | 3.0 | [7/13] (34/3) | Double, tabular |
| M | 2.0 | 0.07 | 15 | 1.0 | — | Homogeneous, finely divided |

In Table 6, (1) Emulsions A to H, and J to L were subjected to reduction sensitization with thiourea dioxide and thiosulfonic acid in accordance with an example in JP-A-2-191938;

(2) Emulsions A to H, and J to L were subjected to gold sensitization, sulfur sensitization and selenium sensitization in the presence of the spectral sensitizing dye as set forth with reference to the various light-sensitive layers and sodium thiocyanate in accordance with an example in JP-A-3-237450;

(3) The preparation of tabular grains was conducted with the use of a low molecular weight gelatin in accordance with an example in JP-A-1-158426;

(4) The tabular grains and normal crystal grains having a grain structure were observed under a high voltage electron microscope to exhibit a transition line as described in JP-A-3-237450; and (5) Emulsions A to H, and J to L comprise iridium incorporated in the grains by the method as described in B. H. Carroll, "*Photographic Science and Engineering*", 24, 265, 1980.

UV-1
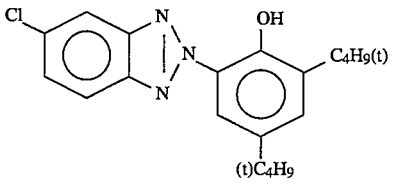
UV-2
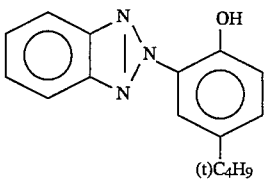
UV-3
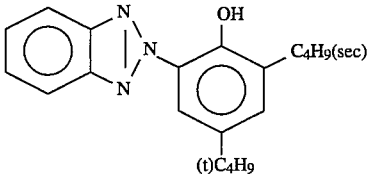
UV-4
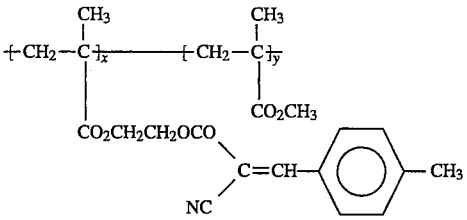
x:y = 70:30 (wt %)
UV-5
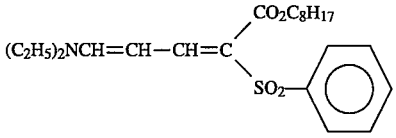
ExF-1
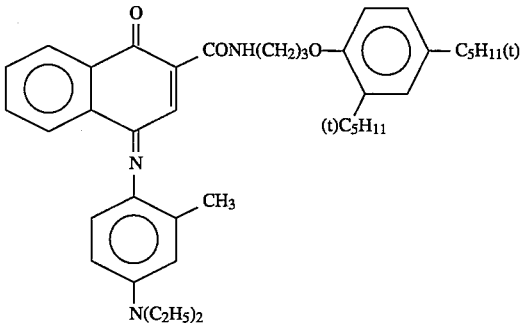
ExF-2
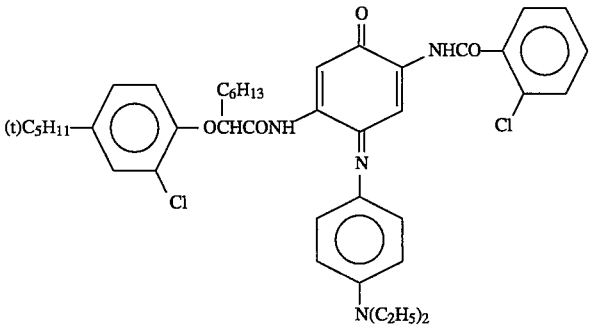
ExF-3
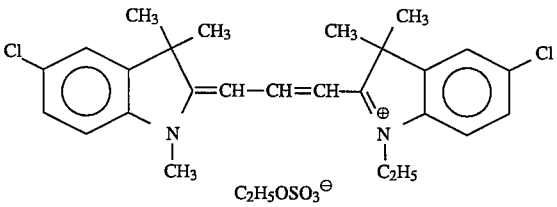

-continued
ExC-1
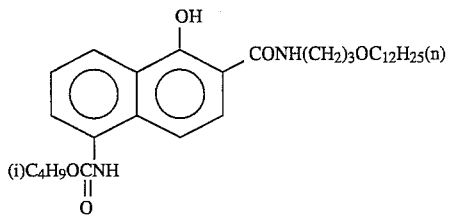
ExC-2
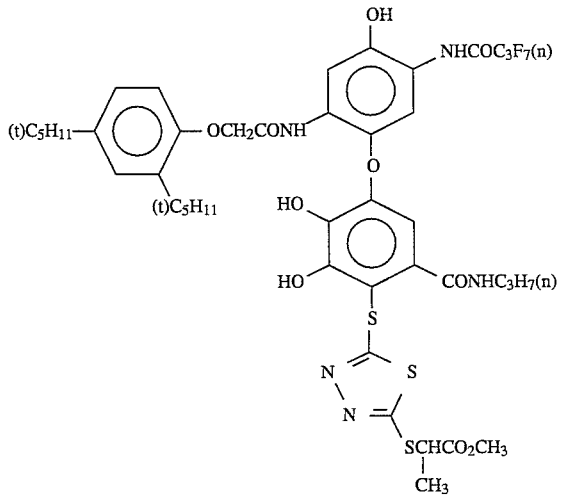
ExC-3
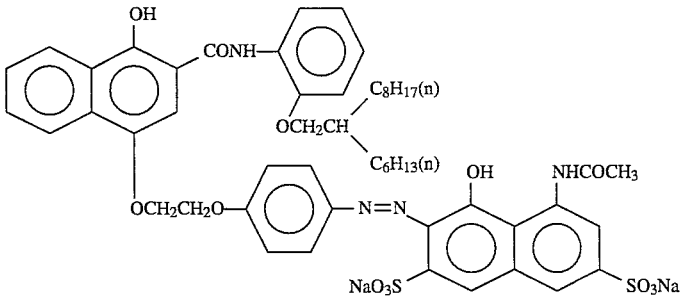
ExC-4
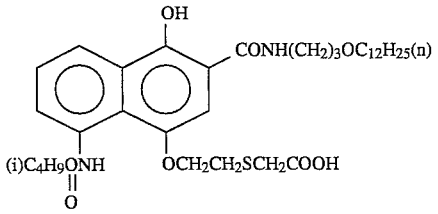
ExC-5
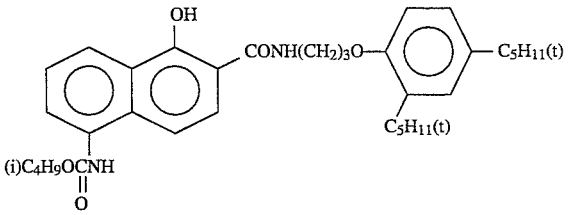

-continued
ExC-6
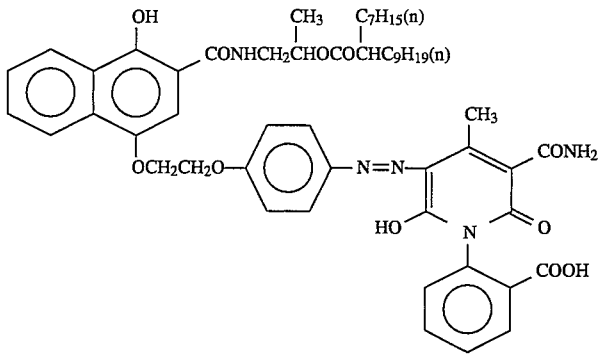
ExC-7
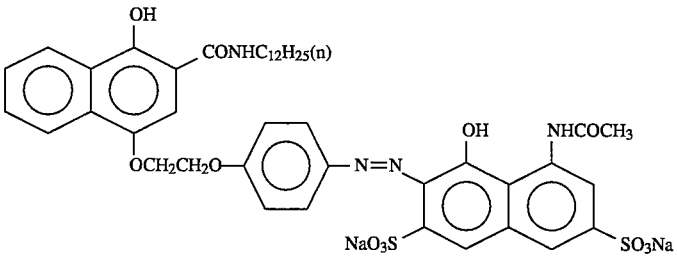
ExC-8
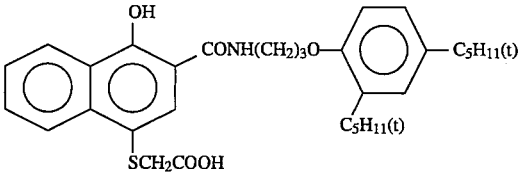
ExC-9
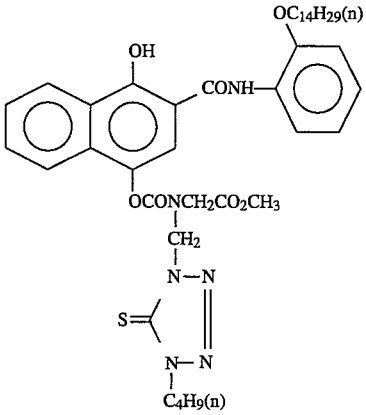

-continued
ExM-1
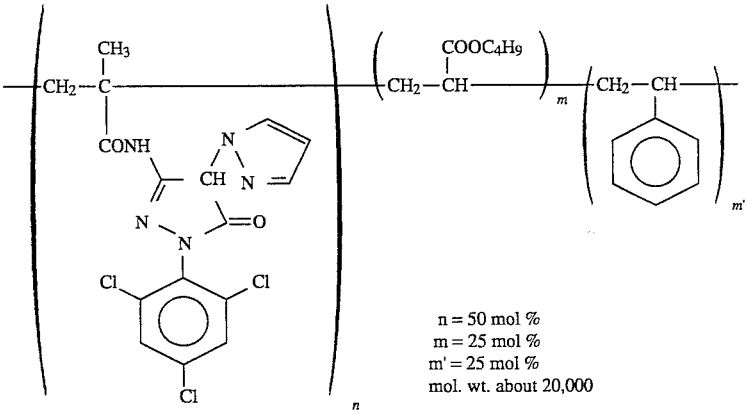
ExM-2
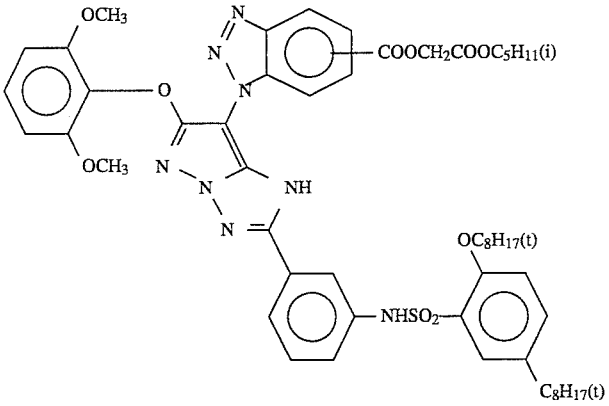
ExM-3
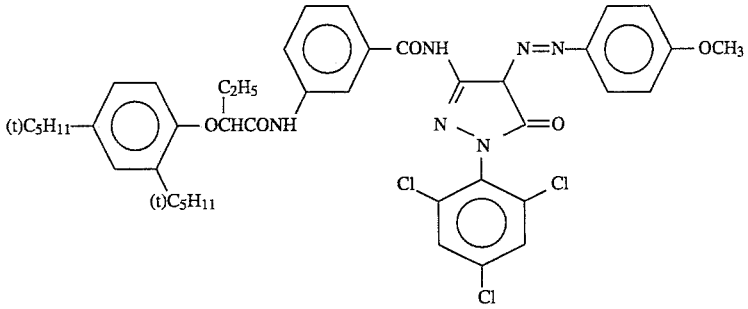
ExM-4
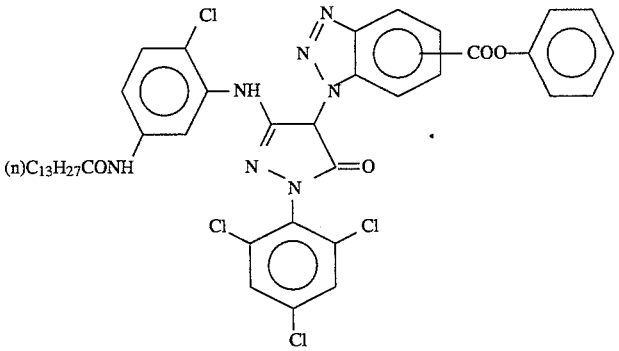

-continued
ExM-5
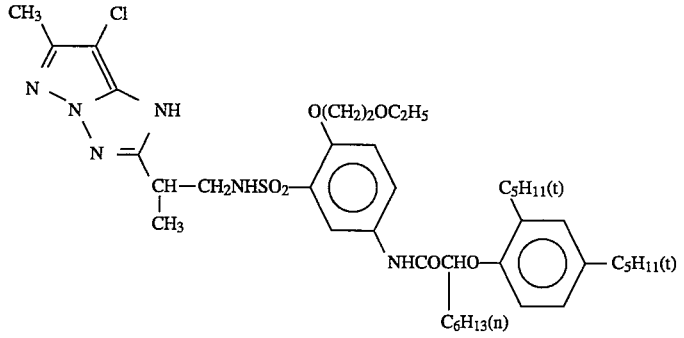
ExM-6
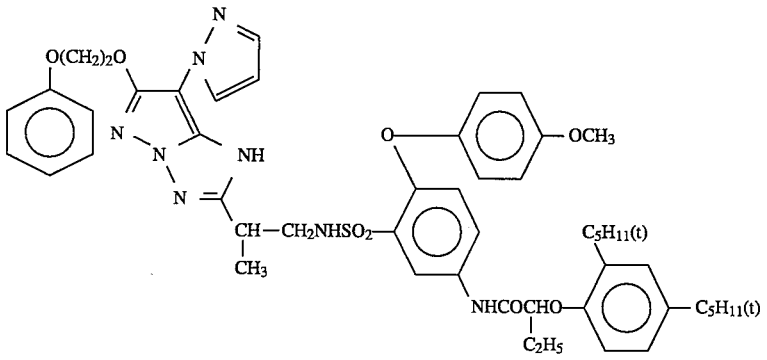
ExM-7
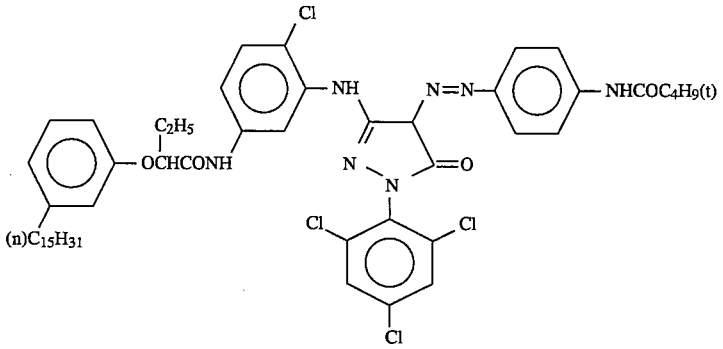
ExY-1
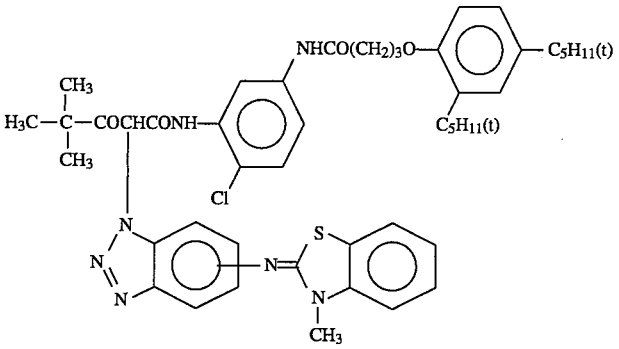

-continued
ExY-2
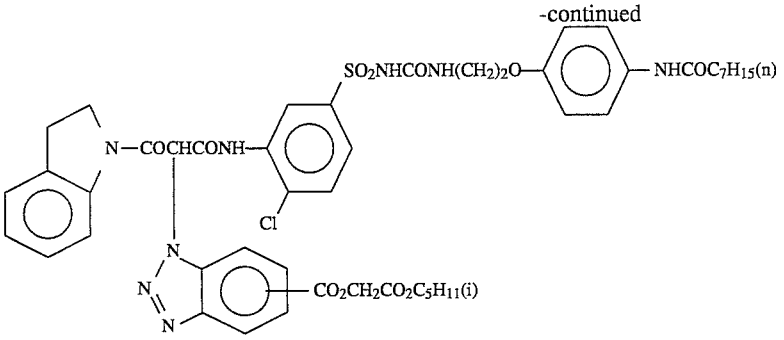
ExY-3
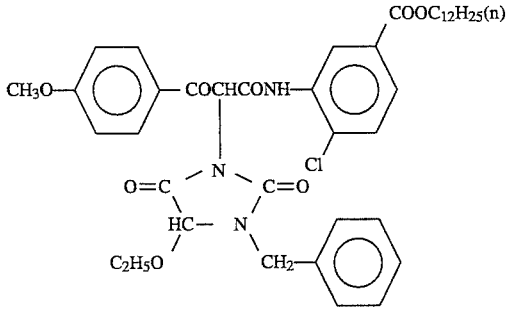
ExY-4
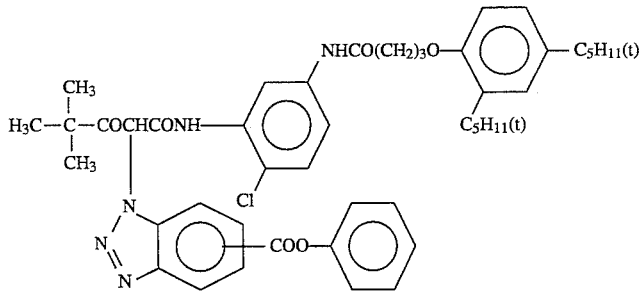
ExY-5
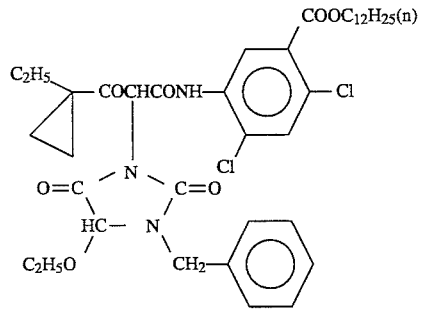
Cpd-1
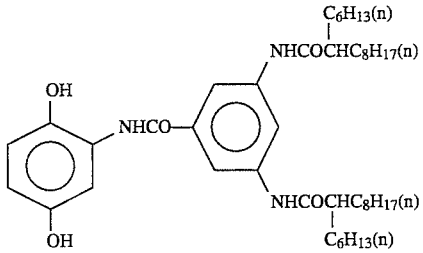
Cpd-2
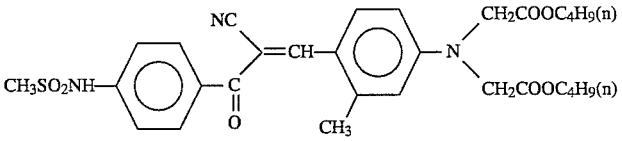

-continued
Cpd-3
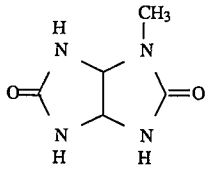
Cpd-4
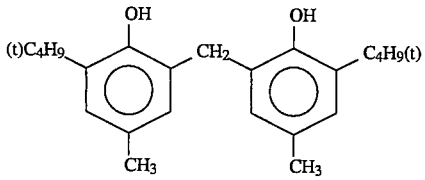
Cpd-5
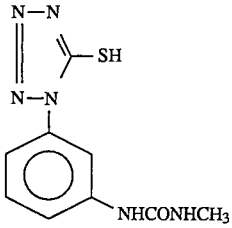
Cpd-6
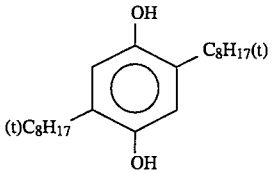
Solv-1
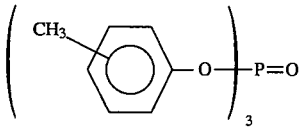
Solv-2
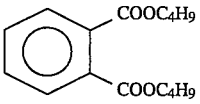
Solv-3
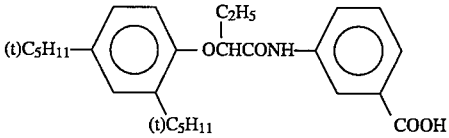
Solv-4
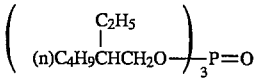
Solv-5
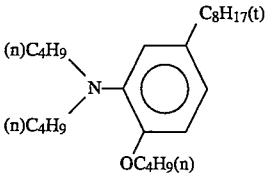

-continued
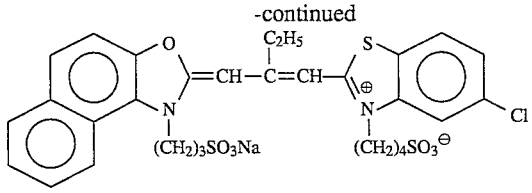
ExS-1
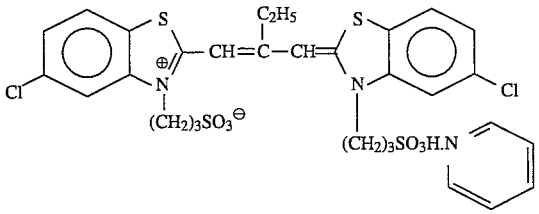
ExS-2
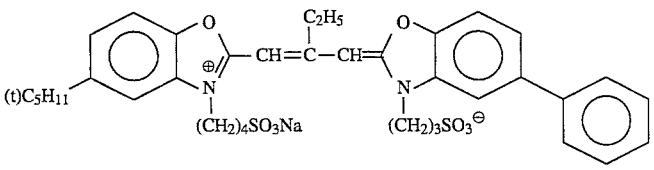
ExS-3
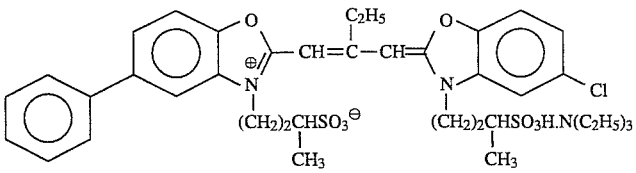
ExS-4
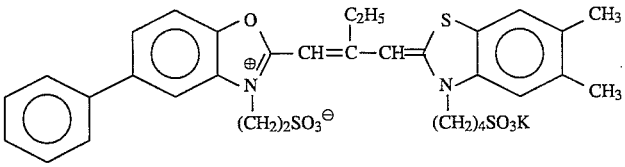
ExS-5
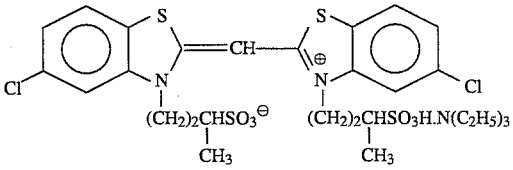
ExS-6
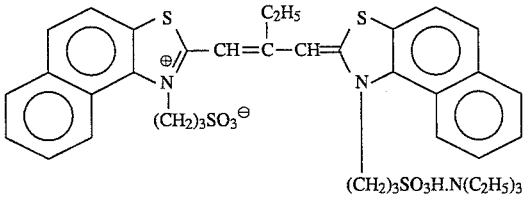
ExS-7
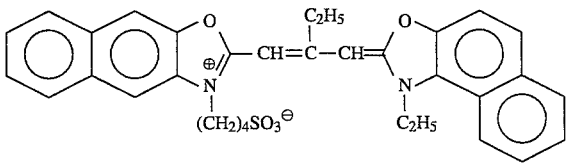
ExS-8
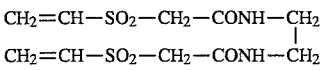
H-1

-continued
W-1
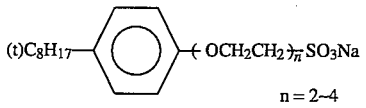
W-2
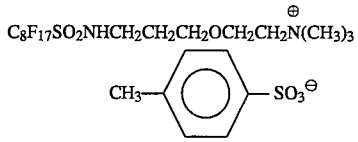
W-3
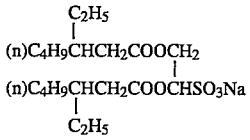
W-4
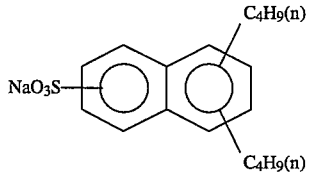
W-5
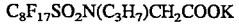
W-6
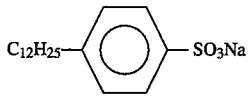
B-1
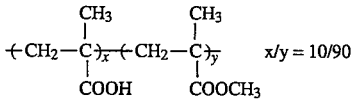
B-2
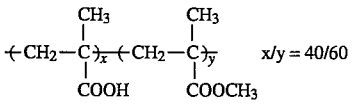
B-3
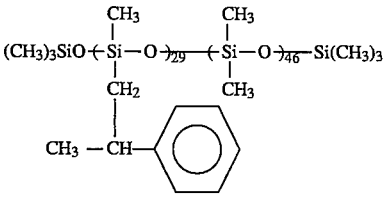
B-4
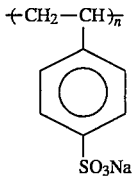
B-5
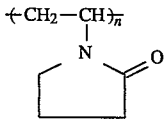
(mol. wt. about 10,000)
B-6
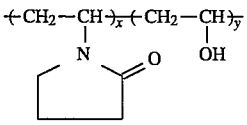
F-1
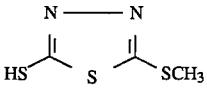
F-2
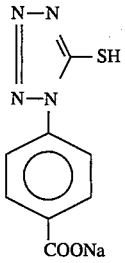
F-3
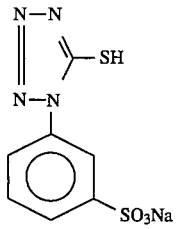
F-4
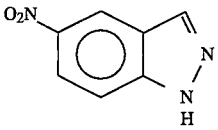
F-5
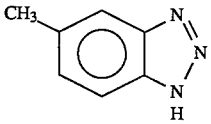
F-6
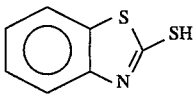

-continued

F-7

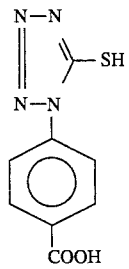

F-8

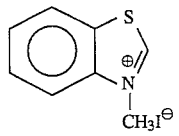

F-9

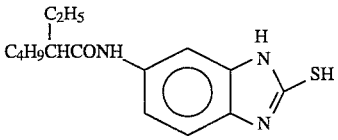

F-10

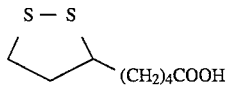

F-11

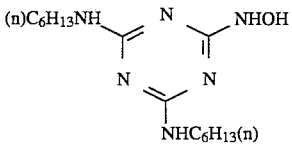

F-12

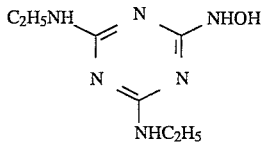

F-13

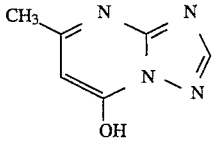

F-14

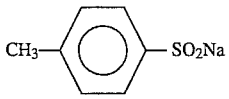

F-15

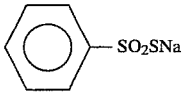

F-16

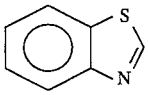

Specimens 102 and 103 were prepared in the same manner as Specimen 101 except that Emulsion I-1 to be incorporated in the 10th layer was replaced by Emulsions I-2 and I-3 as set forth in Table 6 of Example 10, respectively.

Specimens 101 to 103 thus prepared were immediately cut, and then subjected to the following evaluation.

Comparison of photographic sensitivity was made between the specimens which had been subjected to exposure and development immediately after preparation and those which had been stored at a temperature of 50° C. and a relative humidity of 80% for 3 days. These specimens were wedgewise exposed to white light (4,800° K.), and then processed in the following manner. These specimens were then measured for density through a green filter to obtain a characteristic curve on which the reciprocal of the exposure necessary for a magenta density of (fog+1.0) was defined as photographic sensitivity. The results of comparison of photographic properties between before and after storage are set forth in Table 7.

The color photographic light-sensitive material specimens which had been exposed to light were then each processed by means of an automatic developing machine in the following manner (until the accumulated replenishment of the developer reached three times the tank capacity).

(Processing method)

| Processing step | Processing time | Processing temperature | Replenishment rate* | Tank capacity |
|---|---|---|---|---|
| Color development | 3 min. 15 sec. | 38° C. | 22 ml | 20 l |
| Bleach | 3 min. 00 sec. | 38° C. | 25 ml | 40 l |
| Rinse (1) | 15 sec. | 24° C. | Countercurrent process (from tank (2) to tank (1)) | 10 l |
| Rinse (2) | 15 sec. | 24° C. | 15 ml | 10 l |
| Fixing | 3 min. 00 sec. | 38° C. | 15 ml | 30 l |
| Rinse (3) | 30 sec. | 24° C. | Countercurrent process (from tank (4) to tank (3)) | 10 l |

-continued (Processing method)

| Processing step | Processing time | Processing temperature | Replenishment rate* | Tank capacity |
|---|---|---|---|---|
| Rinse (4) | 30 sec. | 24° C. | 1,200 ml | 10 l |
| Stabilizing | 30 sec. | 38° C. | 20 ml | 10 l |
| Drying | 4 min. 20 sec. | 55° C. | | |

*Per 35-mm wide 1-m long strip

The composition of the various processing solutions will be given below.

Color developer

| | Running solution (g) | Replenisher (g) |
|---|---|---|
| Diethylenetriamine-pentaacetic acid | 1.0 | 1.2 |
| 1-Hydroxyethylidene-1,1-diphosphonic acid | 2.0 | 2.2 |
| Sodium sulfite | 4.0 | 4.8 |
| Potassium carbonate | 30.0 | 39.0 |
| Potassium bromide | 1.4 | 0.3 |
| Potassium iodide | 1.5 mg | — |
| Hydroxylamine sulfate | 2.4 | 3.1 |
| 4-[N-ethyl-N-(β-hydroxy-ethyl)amino]-2-methylaniline sulfate | 4.5 | 6.0 |
| Water to make | 1.0 l | 1.0 l |
| pH (adjusted with potassium hydroxide and sulfuric acid) | 10.05 | 10.15 |

Bleaching solution

| | Running solution (g) | Replenisher (g) |
|---|---|---|
| Ferric sodium ethylene-diaminetetraacetate trihydrate | 100.0 | 120.0 |
| Disodium ethylene-diaminetetraacetate | 10.0 | 11.0 |
| 3-Mercapto-1,2,4-triazole | 0.03 | 0.08 |
| Ammonium bromide | 140.0 | 160.0 |
| Ammonium nitrate | 30.0 | 35.0 |
| 27% Aqueous ammonia | 6.5 ml | 4.0 ml |
| Water to make | 1.0 l | 1.0 l |
| pH (adjusted with aqueous ammonia and nitric acid) | 6.0 | 5.7 |

Fixing solution

| | Running solution (g) | Replenisher (g) |
|---|---|---|
| Disodium ethylenediamine-tetraacetate | 0.5 | 0.7 |
| Ammonium sulfite | 20.0 | 22.0 |
| Aqueous solution of ammonium thiosulfate (700 g/l) | 295.0 ml | 320.0 ml |
| 90% Acetic acid | 3.3 | 4.0 |
| Water to make | 1.0 l | 1.0 l |
| pH (adjusted with aqueous ammonia and acetic acid) | 6.7 | 6.8 |

Stabilizing solution (common to running solution and replenisher) (g)

| | |
|---|---|
| p-Nonylphenoxypolyglycidol (average glycidol polymerization degree: 10) | 0.2 |
| Ethylenediaminetetraacetic acid | 0.05 |
| 1,2,4-Triazole | 1.3 |
| 1,4-Bis(1,2,4-triazole-1-ilmethyl) piperadine | 0.75 |
| Hydroxyacetic acid | 0.02 |
| Hydroxyethyl cellulose (HEC SP-2000 available from Daicel Chemical Industries, Ltd.) | 0.1 |
| Gentamicine | 0.01 |
| Water to make | 1.0 l |
| pH | 8.5 |

Table 7 shows that the multi-layer color photographic light-sensitive material of the present example can provide results similar to Example 10. In some detail, as compared with the comparative supersensitizer SS-1, Compound (V-1) of the present invention having a quinoline dye and a supersensitizer connected to each other can provide a high photographic sensitivity and shows a remarkably small photographic sensitivity drop after storage at a temperature of 50° C. and a relative humidity of 80%.

TABLE 7

| Specimen No. | Emulsion in 10th layer: Emulsion No. | Emulsion in 10th layer: Super-sensitizer | Photographic sensitivity: Before storage* | Photographic sensitivity: After storage* |
|---|---|---|---|---|
| 101 (comparative) | I-1 | None | 100 | 95 |
| 102 (comparative) | I-2 | SS-1 | 148 | 111 |
| 103 (the invention) | I-3 | (V-1) | 165 | 157 |

*Before storage: immediately after preparation of coating specimen
After storage: after storage at 50° C.-80% RH for 3 days following preparation of coating specimen It can be seen that the compounds synthesized in Examples 1 to 6 can provide a silver halide photographic material having an enhanced sensitivity which minimizes the formation of fog and exhibits an excellent storage stability as described in Examples 7 to 11.

Thus, the compound according to the present invention is extremely useful for the sensitization of silver halide photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one compound having a methine dye covalently bonded to a styryl base.

2. The silver halide photographic material according to claim 1, wherein said compound is represented by formula (I)

$$(MET)_{k1}-[(Q)_{k2}-(ST)]_{k3} \quad (I)$$

wherein MET represents an atomic group having a methine dye structure; Q represents a divalent linkage group comprising an atom or atomic group containing at least one of a carbon atom, a nitrogen atom, a sulfur atom, and an oxygen atom; ST represents an atomic group having a styryl base structure; $k_1$ is 1 to 2, and $k_3$ is 1, 2, 3, or 4; and $k_2$ is 0 or 1.

3. The silver halide photographic material according to claim 2, wherein MET has a structure represented by formula (II), (III) or (IV)

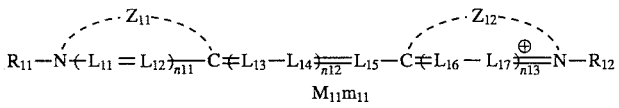

(II)

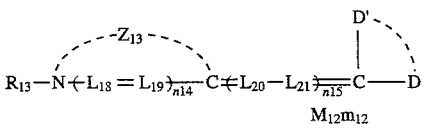

(III)

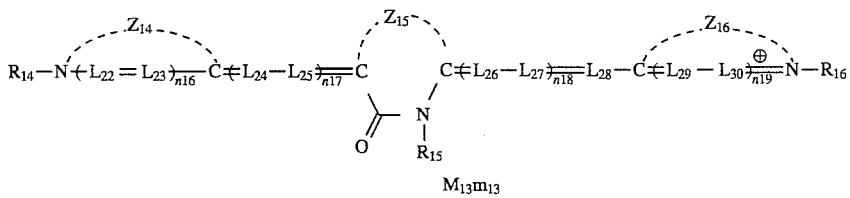

(IV)

wherein $Z_{11}$, $Z_{12}$, $Z_{13}$, $Z_{14}$, $Z_{15}$ and $Z_{16}$ each represents an atomic group necessary for the formation of a 5- or 6-membered nitrogen-containing heterocyclic group; D and D' each represents an atomic group necessary for the formation of a noncyclic or cyclic acidic nucleus; $R_{11}$, $R_{12}$, $R_{13}$, $R_{14}$ and $R_{16}$ each represents a substituted or unsubstituted alkyl group; $R_{15}$ represents a substituted or unsubstituted alkyl group, aryl group or heterocyclic group; $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{29}$ and $L_{30}$ each represents a substituted or unsubstituted methine group; $M_{11}$, $M_{12}$ and $M_{13}$ each represents a charge neutralizing paired ion; $m_{11}$, $m_{12}$ and $m_{13}$ each represents a number of 0 or more necessary for the neutralization of electric charge in the molecule; $n_{11}$, $n_{13}$, $n_{14}$, $n_{16}$ and $n_{19}$ each represents 0 or 1; and $n_{12}$, $n_{15}$, $n_{17}$ and $n_{18}$ each represents an integer 0 or more provided that the dye structures represented by formulae (II), (III), and (IV) each is substituted by at least one —$(Q)_{k2}$—(ST).

4. The silver halide photographic material according to claim 3, wherein the position at which —$(Q)_{k2}$—(ST) substitutes for the dye structure represented by formula (II), (III) or (IV) is on a group represented by $R_{11}$, $R_{12}$, $R_{13}$, $R_{14}$, $R_{15}$ or $R_{16}$.

5. The silver halide photographic material according to claim 4, wherein ST has a structure represented by formula (VII)

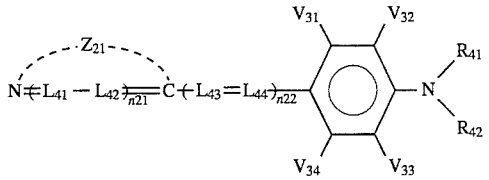

(VII)

wherein $Z_{21}$ represents an atomic group necessary for the formation of a 5- or 6-membered nitrogen-containing heterocyclic group; $V_{31}$, $V_{32}$, $V_{33}$ and $V_{34}$ each represents a hydrogen atom or monovalent substituent; $R_{41}$ and $R_{42}$ each represents a substituted or unsubstituted alkyl group, aryl group or heterocyclic group; $L_{41}$, $L_{42}$, $L_{43}$ and $L_{44}$ each represents a substituted or unsubstituted methine group; $n_{21}$ represents 0 or 1; and $n_{22}$ represents 1, 2 or 3.

6. The silver halide photographic material according to claim 2, wherein MET has a structure represented by formula (V) or (VI);

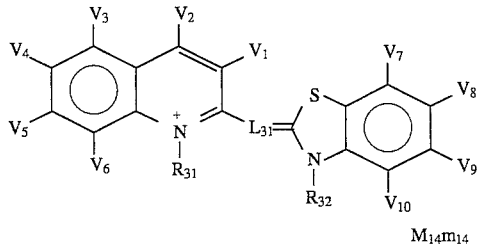

(V)

$M_{14}m_{14}$

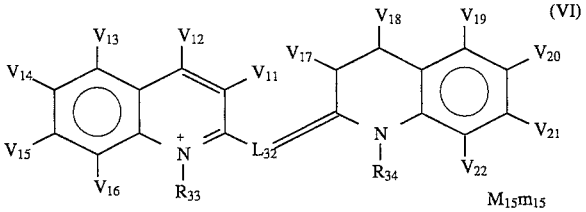

(VI)

$M_{15}m_{15}$ wherein $R_{31}$, $R_{32}$, $R_{33}$ and $R_{34}$ each represents a substituted or unsubstituted alkyl group; $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$ and $V_{22}$ each represents a hydrogen atom or monovalent substituent; $L_{31}$ and $L_{32}$ each represents a substituted or unsubstituted methine group; $M_{14}$ and $M_{15}$ each represents a charge-neutralizing paired ion; and $m_{14}$ and $m_{15}$ each represents a number of 0 or more necessary for the neutralization of electric charge in the molecule, provided that the dye structure represented by formulae (V) and (VI) each is substituted by at least one $—(Q)_{k2}—(ST)$.

7. The silver halide photographic material according to claim 6, wherein the position at which $—(Q)_{k2}—(ST)$ substitutes for the structure represented by formula (V) or (VI) is on said substituted or unsubstituted alkyl group represented by $R_{31}$, $R_{32}$, $R_{33}$ or $R_{34}$.

8. The silver halide photographic material according to claim 2, wherein ST has a structure represented by formula (VII)

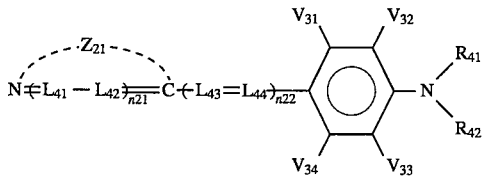

(VII)

wherein $Z_{21}$ represents an atomic group necessary for the formation of a 5- or 6-membered nitrogen-containing heterocyclic group; $V_{31}$, $V_{32}$, $V_{33}$ and $V_{34}$ each represents a hydrogen atom or monovalent substituent; $R_{41}$ and $R_{42}$ each represents a substituted or unsubstituted alkyl group, aryl group or heterocyclic group; $L_{41}$, $L_{42}$, $L_{43}$ and $L_{44}$ each represents a substituted or unsubstituted methine group; $n_{21}$ represents 0 or 1; and $n_{22}$ represents 1, 2 or 3, provided that the structure represented by formula (VII) is substituted by at least one $—(Q)_{k2}—(MET)_{k1}$.

9. The silver halide photographic material according to claim 8, wherein the position at which $—(Q)_{k2}—(MET)_{k1}$ substitutes for the structure represented by formula (VII) is on $R_{41}$ or $R_{42}$.

10. The silver halide photographic material according to claim 2, wherein Q represents a divalent linkage group comprising one or more groups selected from alkylene group, arylene group, alkenylene group, carbonamide group, ester group, sulfonamide group, sulfonic ester group, ureide group, sulfonyl group, sulfinyl group, thioether group, ether group, carbonyl group, —N(R')— and divalent heterocyclic group wherein R' represents a hydrogen atom or a substituted or unsubstituted alkyl or aryl group.

11. The silver halide photographic material according to claim 2, wherein Q represents an ester group or a carbonamide group.

12. The silver halide photographic material according to claim 2, wherein said compound represented by formula (I) is added to a silver halide emulsion in an amount of $1\times10^{-6}$ to $5\times10^{-1}$ mol per mole of silver halide.

* * * * *